US010551125B2

(12) United States Patent
Hanzawa et al.

(10) Patent No.: US 10,551,125 B2
(45) Date of Patent: Feb. 4, 2020

(54) COMBUSTION APPARATUS, AND HEATING FURNACE USING SAME

(71) Applicant: NGK Insulators, Ltd., Nagoya (JP)

(72) Inventors: Shigeru Hanzawa, Nagoya (JP); Kouji Ogura, Nagoya (JP); Hitoshi Mori, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 920 days.

(21) Appl. No.: 14/304,026

(22) Filed: Jun. 13, 2014

(65) Prior Publication Data

US 2014/0295367 A1 Oct. 2, 2014

Related U.S. Application Data

(63) Continuation of application No. PCT/JP2012/080344, filed on Nov. 22, 2012.

(30) Foreign Application Priority Data

Dec. 27, 2011 (JP) ..... 2011-286410

(51) Int. Cl.
*F27D 7/06* (2006.01)
*F23L 7/00* (2006.01)
(Continued)

(52) U.S. Cl.
CPC ..... *F27D 7/06* (2013.01); *F23L 7/00* (2013.01); *F27D 19/00* (2013.01); *F27D 21/0014* (2013.01); *F27D 2019/0003* (2013.01)

(58) Field of Classification Search
CPC ..... F27D 7/06
(Continued)

(56) References Cited

U.S. PATENT DOCUMENTS 3,351,331 A * 11/1967 Martin ..... F27B 17/0075 236/15 BF
4,453,913 A * 6/1984 Gitman ..... F23D 14/34 431/174
(Continued)

FOREIGN PATENT DOCUMENTS

DE 198 13 731 A1 10/1998
DE 197 52 335 A1 5/1999
(Continued)

OTHER PUBLICATIONS

Japanese Office Action (Application No. 2013-551538) dated Nov. 8, 2016 (with English translation).
(Continued)

*Primary Examiner* — Steven B McAllister
*Assistant Examiner* — John E Bargero
(74) *Attorney, Agent, or Firm* — Burr & Brown, PLLC

(57) ABSTRACT

Provided is a technology for uniformly increasing atmosphere temperature while rapidly achieving a desired uniform atmosphere composition. A combustion apparatus is provided with: a combustion part including a combustion space with a combustible gas inlet which is opened toward the combustion space for allowing the entry of a combustible gas, an air inlet which is opened toward the combustion space for allowing the entry of air, and a combustion gas outlet for discharging a combustible gas to the outside; and a regulated gas through channel part including a regulated gas outlet for discharging the gas prepared into a desired composition to the outside, the regulated gas outlet located adjacent to the combustion gas outlet and having an opening facing the combustion gas immediately after being discharged from the combustion gas outlet.

16 Claims, 23 Drawing Sheets

(51) Int. Cl.
*F27D 19/00* (2006.01)
*F27D 21/00* (2006.01)

(58) Field of Classification Search
USPC ..... 432/49, 159, 198, 200; 110/297
See application file for complete search history.

(56) References Cited

U.S. PATENT DOCUMENTS

| | | | | |
|---|---|---|---|---|
| 4,657,504 | A | 4/1987 | Akiyama et al. | |
| 5,868,977 | A | 2/1999 | Ito et al. | |
| 6,113,386 | A * | 9/2000 | Shannon | C21D 1/52 432/146 |
| 6,327,861 | B2 * | 12/2001 | Sato | F23C 9/00 60/746 |
| 6,946,101 | B1 | 9/2005 | Jing | |
| 7,273,366 | B1 | 9/2007 | Sujata | |
| 2003/0017429 | A1 | 1/2003 | Cho | |
| 2011/0094239 | A1 * | 4/2011 | Koizumi | F23R 3/346 60/776 |

FOREIGN PATENT DOCUMENTS

| | | | |
|---|---|---|---|
| JP | 47-031222 | A1 | 11/1972 |
| JP | 52-76736 | A | 6/1977 |
| JP | 53-141931 | A1 | 12/1978 |
| JP | 05-296411 | A1 | 11/1993 |
| JP | 07-077314 | A1 | 3/1995 |
| JP | H08-291328 | A | 11/1996 |
| JP | 09-257372 | A1 | 10/1997 |
| JP | 11-304367 | A1 | 11/1999 |
| JP | 2000-356341 | A1 | 12/2000 |
| JP | 2003-500628 | A1 | 1/2003 |
| JP | 2003-130311 | A1 | 5/2003 |
| JP | 2008-261619 | A1 | 10/2008 |
| JP | 2010-002056 | A1 | 1/2010 |
| WO | 00/22362 | A1 | 4/2000 |
| WO | 00/73699 | A1 | 12/2000 |
| WO | 2007/085317 | A1 | 8/2007 |

OTHER PUBLICATIONS

Chinese Office Action (With English Translation), Chinese Application No. 201280062715.9, dated Sep. 6, 2015 (16 pages).

Extended European Search Report (Application No. 12862260.2) dated Jul. 16, 2015.

European Office Action (Application No. 12862260.2) dated Apr. 4, 2016.

International Search Report and Written Opinion (Application No. PCT/JP2012/080344) dated Feb. 19, 2013.

* cited by examiner row I (cross-section G-G')

COMBUSTION APPARATUS, AND HEATING FURNACE USING SAME

BACKGROUND OF THE INVENTION

1. Field of the Invention

The present invention pertains to a combustion apparatus and a heating furnace using the same.

2. Description of Related Art

When manufacturing various products, heating treatment is sometimes carried out. It is sometimes required that the heating treatment closely manage the composition of the atmosphere into which an object to be heated is placed upon heating in addition to controlling the amount of heat provided to the object. For example, when manufacturing ceramic products, a formed body formed in a desired shape is first manufactured from ceramic powder, after which, heat treatment (firing) is carried out by placing this formed body into a heating furnace.

Burners are sometimes used for controlling the temperature in the heating furnace. As a burner used for the heating furnace, for example, a type (excess type) for generating flames while appropriately adjusting the mixing ratio of the combustion gas along with the air inside the annular body is proposed (for example, Patent Document 1).

Furthermore, during heat treatment (firing) of ceramics, a very low oxygen concentration in the heating furnace should sometimes be maintained in order to prevent oxidation of the ceramics. Therefore, the atmosphere in the heating furnace is adjusted to contain the desired composition by introducing a regulated gas (process gas) with the composition regulated in advance into the heating furnace.

Therefore, in order to freely control the temperature and the atmospheric composition in the heating furnace, respectively, a technology involving individually placing combustion apparatuses such as a burner and regulated gas introducing apparatuses in the heating furnace has been proposed (for example, Patent Documents 2, 3).

PRIOR ART DOCUMENTS

Patent Documents

Patent Document 1: JP-A-H07-77314
Patent Document 2: JP-A-H11-304367
Patent Document 3: JP-A-2010-2056

SUMMARY OF THE INVENTION

Problems to be Solved by the Invention

However, according to the abovementioned technology involving individually placing combustion apparatuses and regulated gas introducing apparatuses, the composition of a gas to be discharged from the combustion apparatus and the composition of a regulated gas (process gas) discharged from the regulated gas introducing apparatus are sometimes different. In such a case, the atmospheric composition in the heating furnace is easily variable at each location in the heating furnace. In addition, for the case in which the temperature of a gas discharged from the combustion apparatus and the temperature of a regulated gas (process gas) discharged from the regulated gas introducing apparatus are different, the temperatures in the heating furnace are also subject to non-uniformity.

That said, it is conceivable that a high-temperature gas with a uniform composition may be discharged from the burner via a contraption by which a combustible gas, air, and a regulated gas are mixed in advance to be burned in the abovementioned excess air type burner. However, such a contraption is subjected to accidental fire and imperfect combustion as the oxygen concentration during combustion is lowered due to the incorporation of a regulated gas.

The present invention has been created in light of the abovementioned problems, with an object of providing a technology that evenly elevates the atmospheric temperature while quickly homogenizing the atmosphere into a desired composition.

Means to Solve the Problems

The present invention provides a combustion apparatus, along with a heating furnace using the same to be described below.

According to a first aspect of the present invention, a combustion apparatus is provided, comprising: a combustion part provided with a combustion space for generating a combustion gas by burning a combustible gas and air, a combustible gas inlet being opened to said combustion space for allowing said combustible gas to flow into said combustion space, an air inlet opened to said combustion space for allowing said air to flow into said combustion space, and a combustion gas outlet for discharging said combustion gas outside; and a regulated gas through channel part having a regulated gas outlet for discharging a regulated gas prepared into a desired composition outside, said regulated gas through channel part being adjacent to said combustion gas outlet and opened toward said combustion gas just after being discharged from said combustion gas outlet.

According to a second aspect of the present invention, combustion apparatus according to the first aspect is provided, wherein said regulated gas outlet is annularly opened, and said combustion gas outlet is provided inside the ring of said regulated gas outlet.

According to a third aspect of the present invention, the combustion apparatus according to the first aspect is provided, comprising a plurality of said regulated gas outlets, wherein said plurality of regulated gas outlets surround said combustion gas outlet.

According to a fourth aspect of the present invention, the combustion apparatus according to the second or third aspects is provided, comprising a structure in which said regulated gas through channel part surrounds said combustion part as seen from a cross-section view crossing said combustion part and said regulated gas through channel part.

According to a fifth aspect of the present invention, the combustion apparatus according to any one of the first to fourth aspects is provided, wherein said combustion part comprises: an air spouting port opened to said combustion space for spouting air in said combustion space in the direction of said combustion gas outlet; and a partition member provided in said combustion space for mixing said combustion gas generated by said combustion with said air spouted from said air spouting port into said combustion space while partitioning said combustible gas flowed from said combustible gas inlet into said combustion space, air flowed from said air inlet into said combustion space, flames generated by the combustion of said air and said combustible gas, and said air spouted from said air spouting port into said combustion space.

According to a sixth aspect of the present invention, the combustion apparatus according to the fifth aspect is provided, wherein, in said combustion part, said partition member is formed in a cylindrical shape with one end closed and the other end opened in the direction of said combustion gas outlet, with said combustible gas inlet and said air inlet further opened inside said cylindrical shape, and said air spouting port is provided such that said air spouted from said air spouting port into said combustion space flows along the outer periphery of said partition member.

According to a seventh aspect of the present invention, a heating furnace, comprising: the combustion apparatus according to any one of said the first to sixth aspects is provided; and a housing chamber in which a housing space for housing a body to be heated is formed surrounded by a furnace wall, and said combustion gas outlet and said regulated gas outlet of said combustion apparatus are opened in said housing space.

According to an eighth aspect of the present invention, the heating furnace according to the seventh aspect is provided, comprising: a temperature measuring part provided at the location opposite to said combustion gas outlet and said regulated gas outlet in said housing space of said housing chamber, which is configured to measure the atmospheric temperature in said housing space; and an inflow regulation means configured to increase or decrease the inflow of said combustible gas from said combustible gas inlet and the inflow of said air from said air inlet based on the atmospheric temperature in said housing space measured by said temperature measuring part.

According, to a ninth aspect of the present invention, the heating furnace according to the eighth aspect is provided, comprising a plurality of said combustion apparatuses and said temperature measuring part; wherein said temperature measuring part is provided at said furnace wall opposite to said combustion gas outlet and said regulated gas outlet of said combustion apparatus of any one of said plurality of combustion apparatuses, and said inflow regulation means increases or decreases the inflow of said combustible gas of said combustion apparatus and the inflow of said air from said air inlet based on the atmospheric temperature in said housing space measured by said temperature measuring part.

According to a tenth aspect of the present invention, the heating furnace according to the ninth aspect is provided, wherein at least one of said combustion apparatuses is provided on the upper and lower parts of said housing chamber, respectively.

According to an eleventh aspect of the present invention the heating furnace according to the ninth aspect is provided, wherein at least one of said combustion apparatuses is provided on the upper, middle, and lower parts of said housing chamber, respectively.

According to a twelfth aspect of the present invention, the heating furnace according to the eighth aspect is provided, comprising: a plurality of said combustion apparatuses; and a plurality of said temperature measuring parts, wherein at least one of said temperature measuring parts is provided at a location opposite to said respective combustion gas outlet and regulated gas outlet of said plurality of combustion apparatuses, and said inflow regulation means increases or decreases the inflow of said combustible gas of said combustion apparatus opposite to said each temperature measuring part, and the inflow of said air from said air inlet based on the atmospheric temperature in said housing space measured by each of said temperature measuring parts.

According to a thirteenth aspect of the present invention, the heating furnace according to the twelfth aspect is provided, wherein at least one of said combustion apparatuses is provided on the upper and lower parts of said housing chamber, respectively.

According to a fourteenth aspect of the present invention, the heating furnace according to the thirteenth aspect is provided, wherein said housing chamber comprises: a first area in which said combustion apparatus provided on said upper part of said furnace wall on one side opens said combustion gas outlet and said regulated gas outlet toward said furnace wall on the opposite side of said one side, and said combustion apparatus provided on said lower part of said furnace wall on the opposite side of said one side opens said combustion gas outlet and said regulated gas outlet toward said furnace wall on said one side; and a second area in which said combustion apparatus provided on said upper part of said furnace wall on the opposite side of said one side opens said combustion gas outlet and said regulated gas outlet toward said furnace wall on said one side, and said combustion apparatus provided on said lower part of said furnace wall on said one side opens said combustion gas outlet and said regulated gas outlet toward said furnace wall on the opposite side of said one side, wherein said first area and said second area are alternately arranged in the longitudinal direction of said housing chamber.

According to a fifteenth aspect of the present invention, the heating furnace according to the twelfth aspect is provided, wherein at least one of said combustion apparatuses is provided on the upper, middle, and lower parts of said housing chamber, respectively.

According to a sixteenth aspect of the present invention, the heating furnace according to the fifteenth aspect is provided, wherein said housing chamber comprises: a first area in which said combustion apparatuses provided on said upper part and said lower part of said furnace wall on one side opens said combustion gas outlet and said regulated gas outlet toward said furnace wall on the opposite side of said one side, and said combustion apparatus provided on said middle part of said furnace wall on the opposite side of said one side opens said combustion gas outlet and said regulated gas outlet toward said furnace wall on said one side; and a second area in which said combustion apparatus provided on said upper part and said lower part of said furnace on the opposite side of said one side wall opens said combustion gas outlet and said regulated gas outlet toward said furnace wall on said one side, and said combustion apparatus provided on said middle part of said furnace wall on said one side opens said combustion gas outlet and said regulated gas outlet toward said furnace wall on the opposite side of said one side, wherein said first area and said second area are alternately arranged in the longitudinal direction of said housing chamber.

Effects of the Invention

According to a combustion apparatus and a heating furnace using the same of the present invention, as the combustion gas outlet and the regulated gas outlet are adjacent to each other, and the regulated gas outlet opens toward the combustion gas just after being discharged from the combustion gas outlet, it becomes possible to immediately mix the combustion gas discharged from the combustion gas outlet with the regulated gas discharged from the regulated gas outlet. As a result, according to the combustion apparatus and the heating furnace using the same of the present invention, it becomes possible to evenly elevate the atmospheric temperature while quickly homogenizing the atmosphere into a desired composition.

DETAILED DESCRIPTION OF THE INVENTION

Hereinafter, embodiments of the present invention will be described with reference to the drawings. The present invention is not limited to the following embodiments; moreover, modifications, corrections, and improvements can be added thereto without departing from the scope of the present invention.

Figure 1:
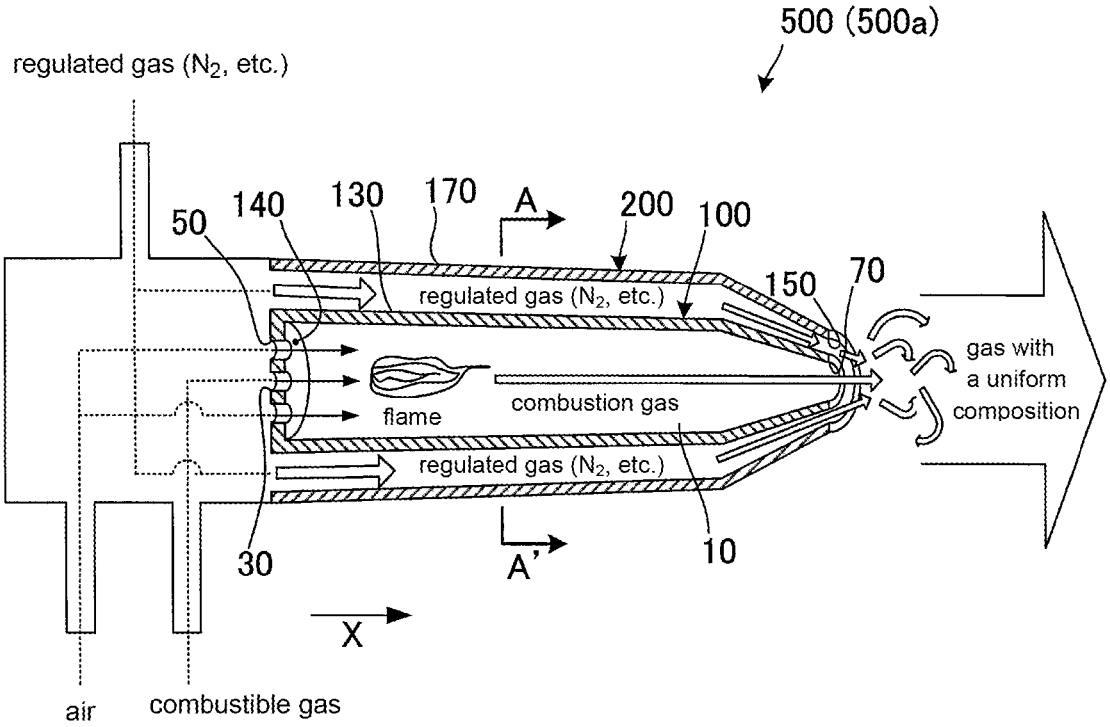
FIG. 1 is a pattern diagram illustrating an embodiment of a combustion apparatus according to the present invention.

1. Combustion Apparatus:

FIG. 1 is a pattern diagram of an embodiment of the combustion apparatus according to the present invention. A combustion apparatus 500*a* of the present embodiment comprises a combustion part 100 and a regulated gas through channel part 200.

As illustrated in the drawing, a combustion part 100 of the combustion apparatus 500*a* according to the present embodiment comprises a cylindrical inner wall 130. This cylindrical inner wall 130 includes one end narrowed to a tapered shape, the front tip of which is opened to be made into a combustion gas outlet 70. In addition, another end of the cylindrical inner wall 130 on the opposite side of the combustion gas outlet 70 is closed by an end wall 140. Thus, the space surrounded by the cylindrical inner wall 130 and the end wall 140 becomes a combustion space 10.

The combustion part 100 of the combustion apparatus 500*a* according to the present embodiment includes the end wall 140 to which one combustible gas inlet 30 and two air inlets 50 are opened. A combustible gas and air flow into the combustion space 10 from each of these combustible gas inlet 30 and air inlet 50.

The combustion part 100 of the combustion apparatus 500*a* according to the present embodiment burns the combustible gas and the air by flowing the combustible gas and the air into the combustion space 10 to generate a high-temperature combustible gas. Subsequently, the high-temperature combustion gas generated in the combustion space 10 of the combustion part 100 is discharged from the combustion gas outlet 70 outside.

The regulated gas through channel part 200 of the combustion apparatus 500*a* according to the present embodiment comprises a regulated gas outlet 150, from which a regulated gas prepared to contain a desired composition is discharged outside.

As illustrated in the drawing, according to the combustion apparatus 500*a* of the present embodiment, the combustion gas outlet 70 and the regulated gas outlet 150 are adjacent to each other, and the regulated gas outlet 150 is opened toward the combustion gas just after being discharged from the combustion gas outlet 70. Thus, when the combustion gas outlet 70 and the regulated gas outlet 150 are adjacent to each other, and the regulated gas outlet 150 is opened toward the combustion gas just after being discharged from the combustion gas outlet 70, it becomes possible to immediately mix the combustion gas discharged from the combustion gas outlet 70 with the regulated gas discharged from the regulated gas outlet 150. As a result, according to the combustion apparatus 500*a* of the present embodiment, it becomes possible to discharge a high-temperature gas with a uniform composition outside.

In addition, according to the combustion apparatus 500*a* of the present embodiment, when the regulated gas is discharged from the regulated gas outlet 150 at a high speed, it also becomes possible to add a force to the high-temperature gas flow with a uniform composition generated together with the combustion gas discharged from the combustion gas outlet 70. Therefore, even if the combustion gas is discharged from the combustion gas outlet 70 at a low speed, it becomes possible to vigorously discharge the high-temperature gas by using the speed of the regulated gas discharged from the regulated gas outlet 150.

Figure 3:
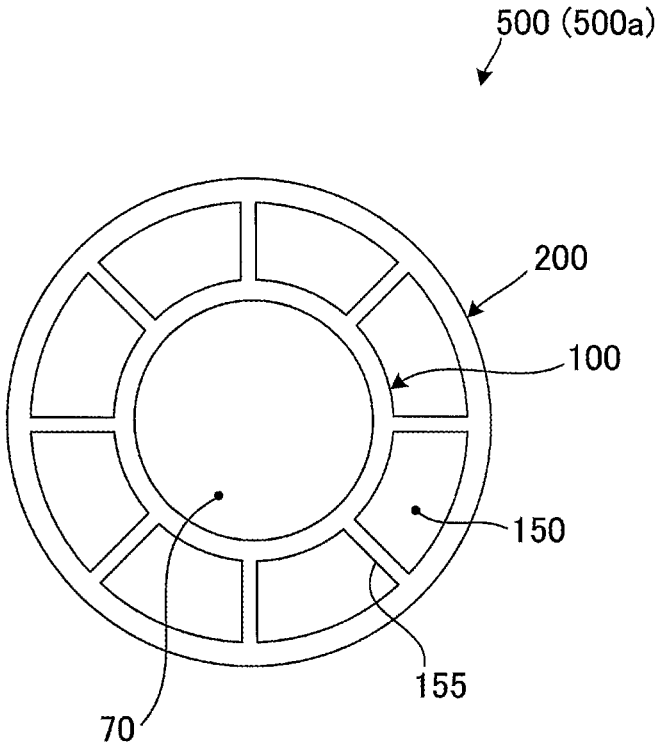
FIG. 3 is a plan view of a modified example of a combustion gas outlet and a regulated gas outlet of an embodiment of the combustion apparatus according to the present invention.
Figure 4:
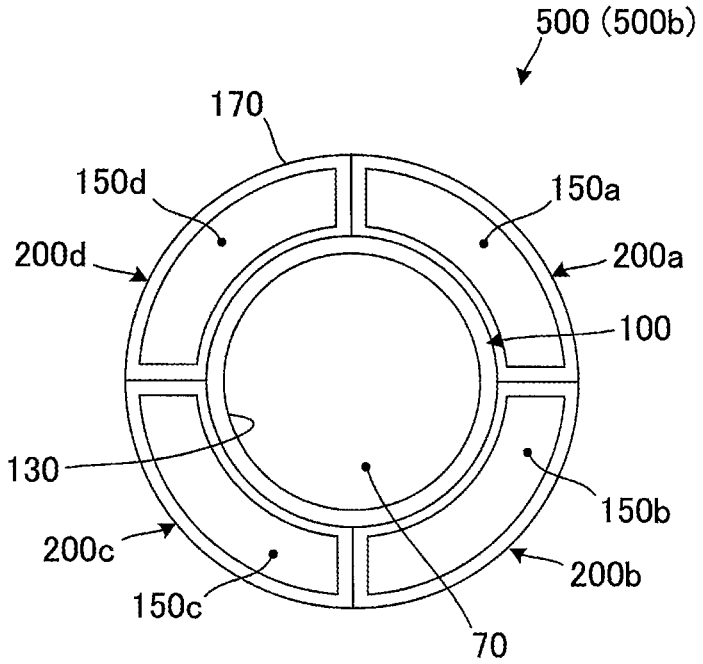
FIG. 4 is a plan view of a combustion gas outlet and a regulated gas outlet of another embodiment of the combustion apparatus according to the present invention.

Furthermore, as with the combustion apparatus 500*a* of the present embodiment, the regulated gas outlet 150 is preferably opened annularly; moreover, the combustion gas outlet 70 is preferably provided inside the ring of this regulated gas outlet 150 (for example, refer to FIG. 3 and FIG. 4). This structure allows the combustion gas to be discharged in a manner of being surrounded by the regulated gas. As a result, it becomes possible to more effectively bring out the abovementioned quick homogenization of a gas by mixing the combustion gas with the regulated gas and the abovementioned action for vigorously discharging a high-temperature gas using the speed of the regulated gas.

Furthermore, as flames generated by the combustion space 10 and the regulated gas are partitioned by the inner wall 130 according to the combustion apparatus 500*a* of the present embodiment, if the regulated gas is an ignitable gas, ignition of the regulated gas can be prevented. In addition, according to the combustion apparatus 500*a* of the present embodiment, even when the regulated gas has an anti-inflammatory action, as the flames and the regulated gas are partitioned, the flames can be maintained.

Figure 2:
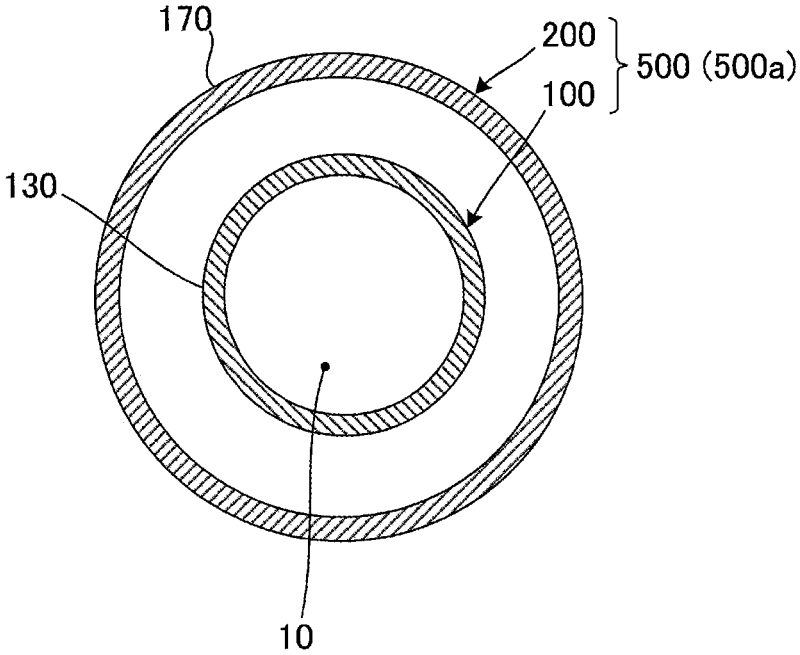
FIG. 2 is a cross-section view along A-A' in FIG. 1.

FIG. 2 is a cross-section view along A-A' in FIG. 1. As illustrated in the drawing, the combustion apparatus 500*a* of the present embodiment is structured to contain the cylindrical inner wall 130 inside a cylindrical outer wall 170. In other words, the combustion apparatus 500*a* of the present embodiment comprises a structure in which the regulated gas through channel part 200 surrounds the combustion part 100 as seen from a cross-section view crossing the combustion part 100 and the regulated gas through channel part 200.

According to the combustion apparatus 500*a* of the present embodiment, the regulated gas through channel part 200 is formed by a double cylindrical structure composed of the cylindrical inner wall 130 and the cylindrical outer wall 170 housing this inner wall 130 contained therein. The regulated gas flows through the space between the inner wall 130 and the outer wall 170.

In addition, as illustrated in FIG. 1 and FIG. 2, the cylindrical inner wall 130 and cylindrical outer wall 170 are preferably formed into a tapered shape that is reduced as they extend downstream of flows of the combustion gas and the regulated gas, in other words, as they extend to the combustion gas outlet 70 and the regulated gas outlet 150. Thus, in the case of making the cylindrical inner wall 130 and the cylindrical outer wall 170 into a taper shape, the speed of the combustion gas when passing through the combustion gas outlet 70 and the speed of the regulated gas when passing through the regulated gas outlet 150 is increased. As a result, it is possible to more effectively bring about the quick homogenization of a gas by mixing the combustion gas with the regulated gas and the action for vigorously discharging a high-temperature gas.

FIG. 3 is a plan view of a modified example of the regulated gas outlet 150 in the combustion apparatus 500*a* according to the present embodiment. As illustrated in the drawing, according to the combustion apparatus 500*a* of the present embodiment, the ring of the regulated gas outlet 150 is preferably partitioned peripherally into a plurality of zones by providing partitions (rectification members 155) formed in the annular regulated gas outlet 150 radially from the center of the ring. Thus, when the partitions (rectification members 155) are provided, the flow of the regulated gas can be easily rectified to have a desired state; moreover, as the partitions (rectification members 155) serve as braces, the structural strength of the regulated gas outlet 150 can be enhanced.

FIG. 4 is a plan view of a combustion gas outlet and a regulated gas outlet of another embodiment of the combustion apparatus according to the present invention. As illustrated in the drawing, the combustion apparatus 500*b* of the present embodiment comprises four regulated gas outlets 150*a* to 150*d*. Furthermore, these four regulated gas outlets 150*a* to 150*d* are arranged one after another such that they surround the combustion gas outlet 70. Such a structure is preferable as the regulated gas is discharged such that it surrounds the combustion gas. That is to say, it becomes possible to more effectively bring out the abovementioned homogenization of a gas by mixing the combustion gas with the regulated gas, and the abovementioned action for vigorously discharging a high-temperature gas using the speed of the regulated gas.

Incidentally, according to the combustion apparatus 500*b* of the present embodiment, the combustion part 100 and the regulated gas through channel parts 200*a* to 200*d* are not an integrated structure but separate structures, respectively.

Figure 5:
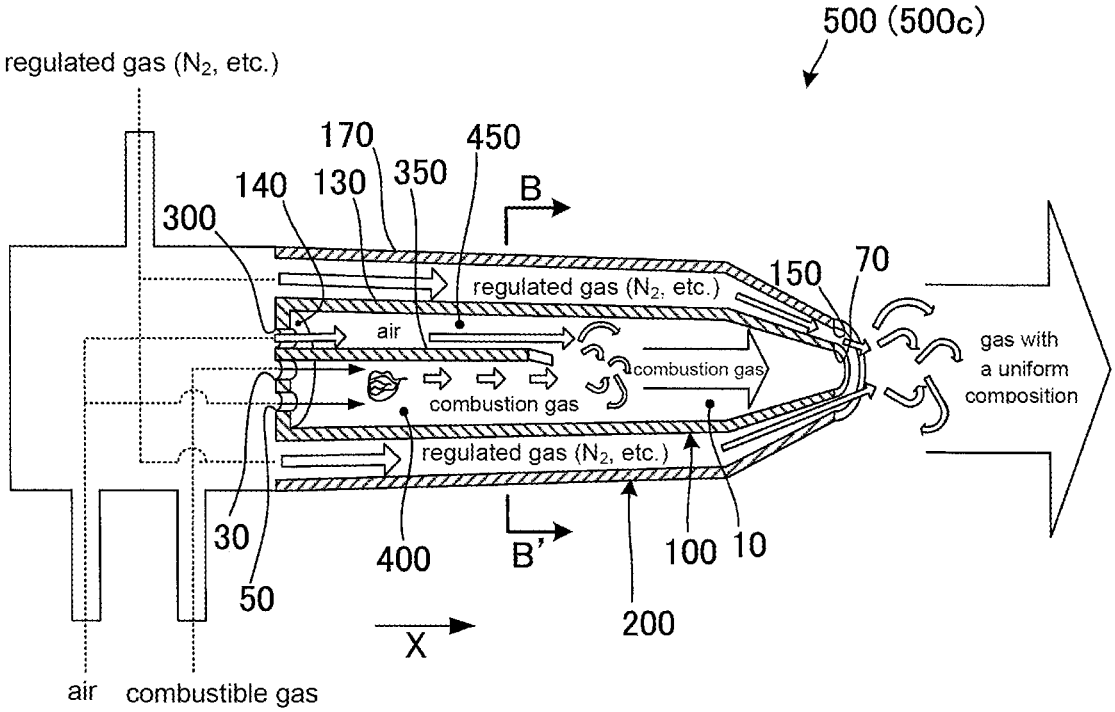
FIG. 5 is a pattern diagram illustrating yet another embodiment of the combustion apparatus according to the present invention.
Figure 6:
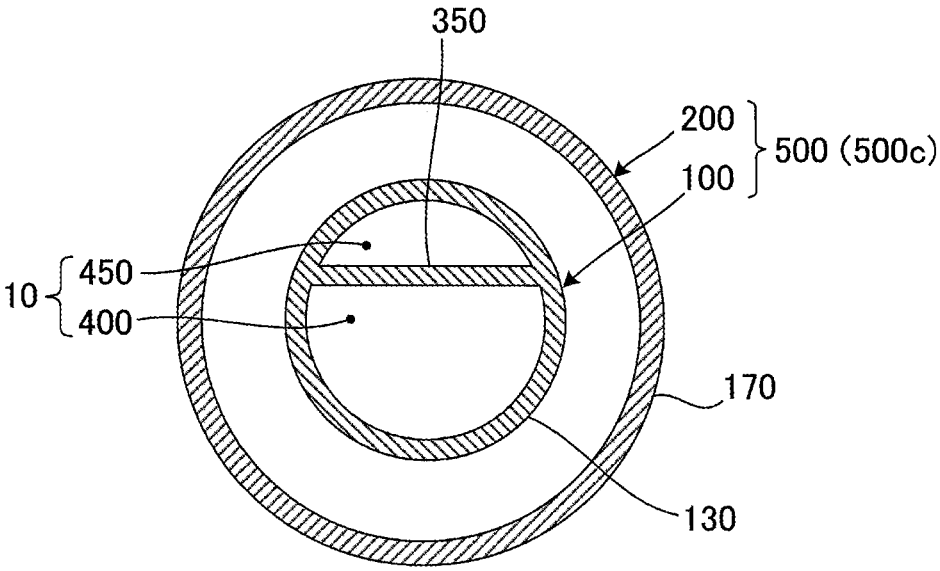
FIG. 6 is a cross-section view along B-B' in FIG. 5.

FIG. 5 is a pattern diagram illustrating yet another embodiment of the combustion apparatus according to the present invention. FIG. 6 is a cross-section view along B-B' in FIG. 5. In a combustion apparatus 500*c* of the present embodiment, a partition member 350 is provided inside of a combustion space 10 of a combustion part 100. The partition member 350 of the combustion apparatus 500*c* according to the present embodiment is a planar member connected to an end wall 140, and said planar member being expanded axially (in the X direction) to the middle portion of the combustion part 100.

As illustrated in the drawing, in the combustion apparatus 500*c* according to the present embodiment, the combustion space 10 on the side of the end wall 140 (the upstream side of the gas flow) is divided into a first space 400 and a second space 450 by this partition member 350.

In the combustion apparatus 500*c* of the present embodiment, as a combustible gas inlet 30 and an air inlet 50 are opened in the first space 400, it is possible to generate a combustion gas by burning a combustion gas and air in this first space 400.

On the other hand, in the combustion apparatus 500*c* of the present embodiment, as an air spouting port 300 is opened in the second space 450, air is spouted into this second space 450. The air spouting port 300 is provided such that air is spouted in the direction of a combustion gas outlet 70 (in the X direction in the combustion apparatus 500*c* of the present embodiment). In the present specification, "the air spouting port 300 is provided such that it spouts air in the direction of the combustion gas outlet 70" means that the air spouting port 300 is opened toward the combustion gas outlet 70 when the air spouting port 300 linearly communicates with the combustion gas outlet 70; moreover, the air spouting port 300 is opened in the direction that a fluid (air) flows from the air spouting port 300 to the combustion gas outlet 70 (the direction from upstream of the fluid flow toward downstream thereof) when the air spouting port 300 does not linearly communicate with the combustion gas outlet 70 (for example, when the combustion part 100 is formed in a curved shape).

The combustion apparatus 500*c* of the present embodiment can separate the combustible gas flowed from the gas inlet 30 into the combustion space 10, the air flowed from the air inlet 50 into the combustion space 10, and flames generated by the combustion of said air and the combustible gas, from the air spouted from air spouting port 300 into combustion space 10 by providing such a partition member 350. As a result, since it is possible to prevent the air spouted from the air spouting port 300 from being mixed into flames, a ratio between the combustible gas and air (the air flowed from air inlet 50) can be kept at a constant ratio appropriate for combustion, making it possible to successfully achieve combustion.

As illustrated in the drawing, as the provided partition member 350 extends only until a middle part of the combustion part 100 in the combustion apparatus 500*c* of the present embodiment, it is possible to mix the combustion gas generated in the first space 400 with the air flowed through the second space 450 in the combustion space 10 on the side of the combustion gas outlet 70 (the downstream side of the gas flow). Here, in the case of spouting air from the air spouting port 300 at a high speed, it is possible to successfully mix the air spouted from the air spouting port 300 with a combustion gas in the combustion space 10 on the side of the combustion gas outlet 70 (the downstream side of the gas flow). Furthermore, as the force of the high-speed air spouted from the air spouting port 300 is added to the combustion gas, it becomes possible to vigorously feed the combustion gas to the combustion gas outlet 70. As a result, it becomes possible to vigorously discharge a high-temperature gas from the combustion apparatus 500*c* of the present embodiment.

Figure 7:
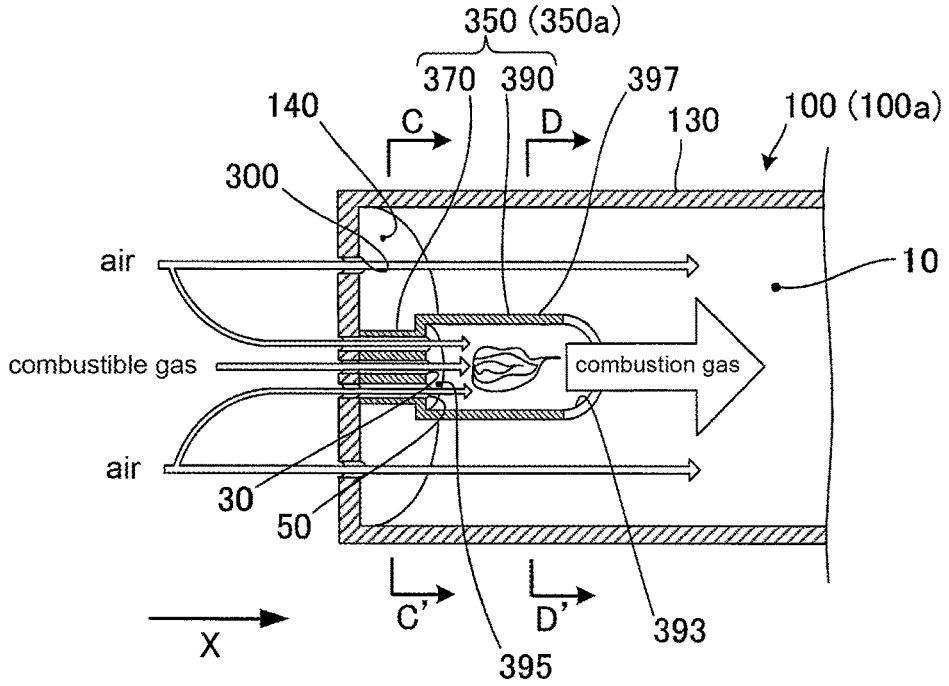
FIG. 7 is a pattern diagram of another embodiment of the combustion apparatus according to the present invention, the combustion part of said combustion apparatus being provided with a partition member.

FIG. 7 is a pattern diagram of another embodiment of the combustion part of the combustion apparatus according to the present invention. As illustrated in the drawing, in a combustion part 100*a* of the present embodiment, a partition member 350*a* comprises a bowl part 390 formed in a cup shape and a support part 370 for fixing the bowl part 390 on a side wall 140. The bowl part 390 of the present embodiment is provided with a cylindrical side wall 397 and a bottom wall 395 that closes one end of said cylindrical shape formed by this side wall 397. According to the present embodiment, the bowl part 390 is fixed in a combustion space 10 by being connected to a support part 370 via the bottom wall 395. In addition, according to the present embodiment, the cylindrical shape of the bowl part 390 extends toward a combustion gas outlet 70, while an open end 393 located at a front end of said cylindrical shape (the end on the opposite side of the bottom wall 395) is opened in the direction toward the combustion gas outlet 70 (in the X direction).

In the present specification, "a combustion gas is opened from the open end 393 toward the combustion gas outlet 70" means that the open end 393 is opened toward the combustion gas outlet 70 when the open end 393 linearly communicates with the combustion gas outlet 70; moreover, the open end 393 is opened in the direction that a fluid (combustion gas) flows from the open end 393 to the combustion gas outlet 70 (the direction from upstream of the fluid flow toward the downstream thereof) when the open end 393 does not linearly communicate with the combustion gas outlet 70 (for example, when the combustion part 100 is formed in a curved shape).

Figure 8:
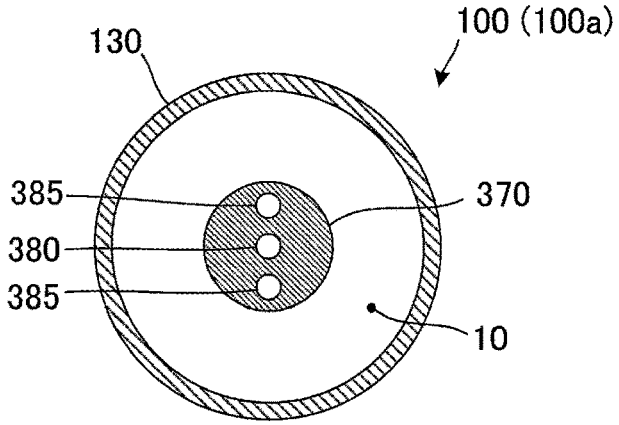
FIG. 8 is a cross-section view along C-C' in FIG. 7.

FIG. 8 is a cross-section view along C-C' in FIG. 7. As illustrated in the drawing, a combustible gas through channel 380 and an air through channel 385 are provided inside the support part 370. As illustrated in FIG. 7, this combustible gas through channel 380 and the air through channel 385 penetrate through the end wall 140, the support part 370, and the bottom wall 395 of the bowl part 390.

Therefore, in the combustion part 100*a* of the present embodiment, the combustible gas inlet 30 and the air inlet 50 are opened to the bottom wall 395 of the bowl part 390 of the partition member 350*a*, enabling the generation of a combustion gas by burning a combustible gas and air inside the cup-shaped bowl part 390. The combustion gas thus generated is discharged from the open end 393 of the bowl part 390 toward the combustion gas outlet 70.

Figure 9:
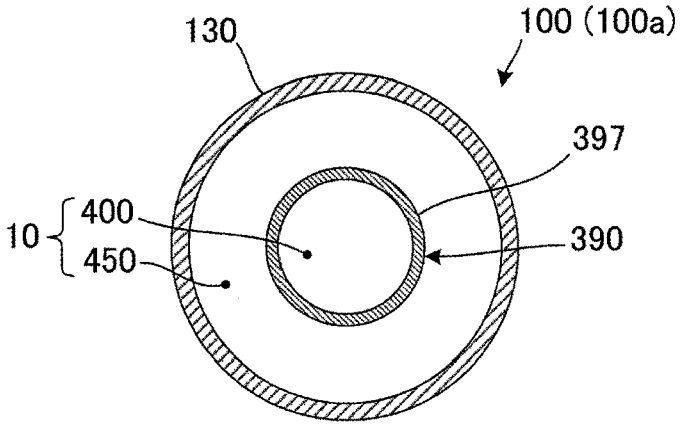
FIG. 9 is a cross-section view along D-D' in FIG. 7.

FIG. 9 is a cross-section view along D-D' in FIG. 7. In the combustion part 100*a* of the present embodiment, the combustion space 10 is partitioned into the first space 400 and the second space 450 by the side wall 397 of the bowl part 390. In other words, the inside of the cylindrical side wall 397 of the bowl part 390 becomes the first space 400, while the outside of the side wall 397 becomes the second space 450.

In addition, as illustrated in FIG. 7, in the combustion part 100*a* of the present embodiment, the air spouting port 300 is opened on the end wall 140 more laterally than the partition member 350*a*. Thereby, it becomes possible to flow air spouted from the air spouting port 300 along the outer periphery of the side wall 397 of the bowl part 390 of the partition member 350*a*. Thus, by using the force of the air flowing along the outer periphery of the side wall 397 of the bowl part 390, the combustion gas discharged from the open end 393 of the bowl part 390 can be securely fed to the combustion gas outlet 70.

Although not illustrated, in the combustion part 100*a* of the present embodiment, with the object of securely feeding a combustion gas to the combustion gas outlet 70, a plurality of air spouting ports 300 are preferably provided on the end wall 140; furthermore, the plurality of air spouting ports 300 are preferably formed such that they surrounds the periphery of the partition member 350*a* (periphery of the support part 370).

Figure 10:
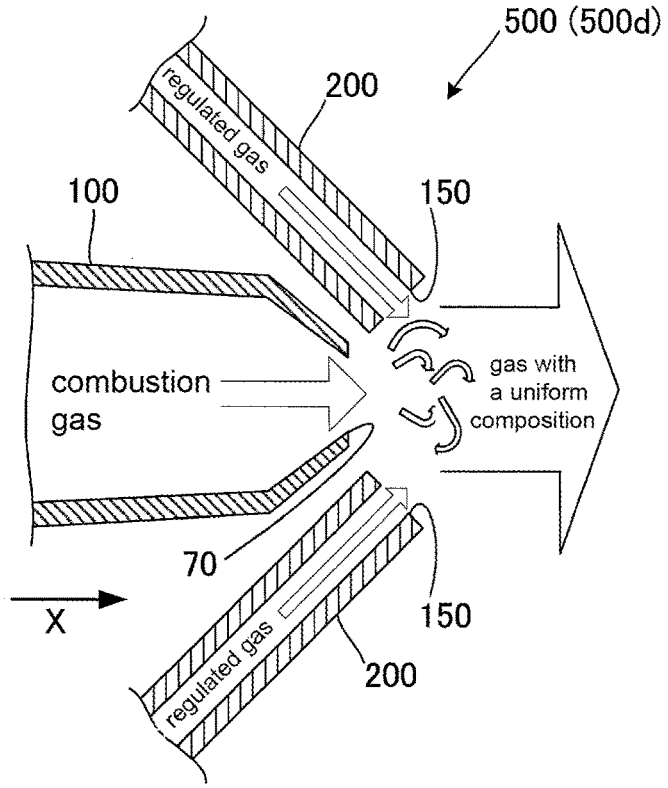
FIG. 10 is a pattern diagram of the periphery of the combustion gas outlet and the regulated gas outlet of an embodiment of the combustion apparatus according to the present invention.

FIG. 10 is a pattern diagram of the periphery of the combustion gas outlet and the regulated gas outlet of an embodiment of the combustion apparatus according to the present invention. A combustion apparatus 500*d* of the present embodiment is provided with a cylindrical combustion part 100 and the cylindrical regulated gas through channel part 200. Furthermore, in the combustion apparatus 500*d* of the present embodiment, the cylindrical regulated gas through channel part 200 extends while intersecting the discharge direction of a combustion gas (X direction) from a combustion gas outlet 70 of the combustion part 100 at an angle of 45 degrees. In the combustion apparatus 500*d* of the present embodiment, a regulated gas outlet 150 is opened such that the regulated gas discharged from the regulated gas outlet 150 is obliquely spouted to the combustion gas just after being discharged from the combustion gas outlet 70 at an angle of 45 degrees. It becomes possible to securely provide quick homogenization of a gas by mixing the combustion gas with the regulated gas via obliquely spouting the regulated gas to the combustion gas in this way.

Furthermore, in the combustion apparatus 500*d* of the present embodiment, the combustion gas outlet 70 and the regulated gas outlet 150 are adjacent to each other in intervals. Thus, in the combustion apparatus of the present invention, as long as it is possible to quickly mix the combustion gas just after being discharged from the combustion gas outlet with the regulated gas just after being discharged from the regulated gas outlet, the combustion gas outlet and the regulated gas outlet are not necessarily closely located.

Figure 11:
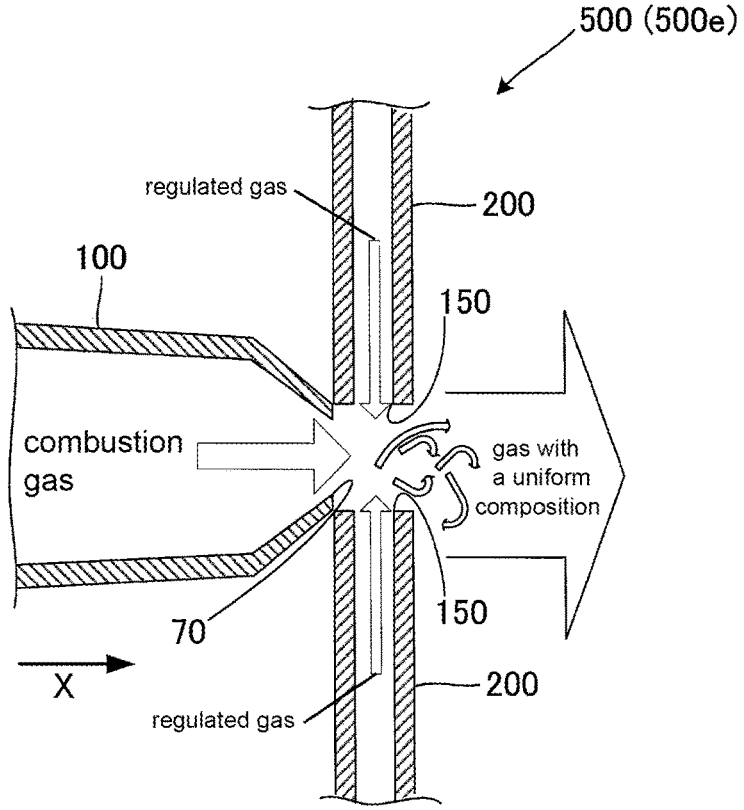
FIG. 11 is a pattern diagram of the periphery of a combustion gas outlet and a regulated gas outlet of another embodiment of the combustion apparatus according to the present invention.

FIG. 11 is a pattern diagram of the periphery of a combustion gas outlet and a regulated gas outlet of an embodiment of the combustion apparatus according to the present invention. A combustion apparatus 500*e* of the present embodiment comprises the cylindrical combustion part 100 and the cylindrical regulated gas through channel part 200. Furthermore, in the combustion apparatus 500*e* of the present embodiment, the cylindrical regulated gas through channel part 200 extends while intersecting the discharge direction of a combustion gas (X direction) from the combustion gas outlet 70 of the combustion part 100 at an angle of 90 degrees. As illustrated in the drawing, in the combustion apparatus 500*e* of the present embodiment, opposing regulated gas through channel parts 200 are opened in front of the combustion gas outlet 70 such that respective regulated gas outlets 150 face each other. Consequently, the combustion apparatus 500*e* of the present embodiment can spout a regulated gas such that it interposes the combustion gas just being discharged from the combustion gas outlet 70. As a result, it becomes possible to facilitate quick homogenization of a gas by mixing the combustion gas with the regulated gas.

Here, the angle made by the discharge direction of the combustion gas from the combustion gas outlet 70 of the combustion part 100 (X direction) and the discharge direction of the regulated gas discharged from the regulated gas outlet 150 is preferably 5 to 90 degrees, more preferably 10 to 70 degrees, and most preferably 15 to 50 degrees, with the object of securely achieving quick homogenization of a gas by mixing the combustion gas with the regulated gas.

The angle made by the abovementioned discharge direction of combustion gas outlet 70 (X direction) and the discharge direction of the regulated gas outlet 150 is defined such that the front end of the combustion gas outlet 70 has a short tubular structure (the length of said tubular structure is no more than four times the width of combustion gas outlet 70); moreover, the same can be applied even when said short tubular structure is provided to extend in the discharge direction of a combustion gas (X direction) (the shortness of the abovementioned tubular structure should be within the acceptable range to the extent that it does not prevent quick homogenization of a gas). When the length of the abovementioned short tubular structure is no more than four times the width of the combustion gas outlet 70, it is possible to quickly homogenize a gas without allowing reflux of the regulated gas discharged from regulated gas outlet 150 by the combustion gas discharged from the combustion gas outlet 70. In addition, when the length of the abovementioned short tubular structure is no more than four times the width of the combustion gas outlet 70, the combustion gas once discharged from the combustion gas outlet 70 is prevented from flowing backward again into the combustion gas outlet 70 by receiving the regulated gas flow, thereby enabling quick homogenization of a gas.

The aforementioned combustion apparatus 500 can be used, for example, for the following heating furnace.

Figure 12:
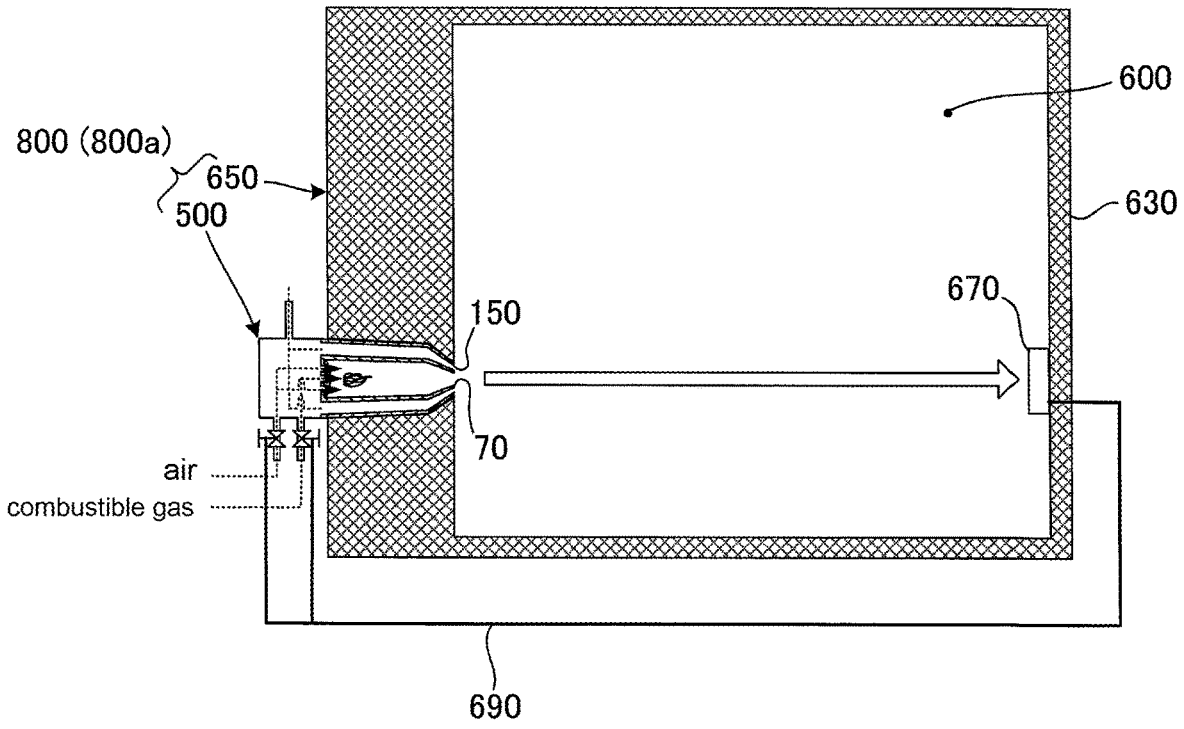
FIG. 12 is a pattern diagram illustrating an embodiment of a heating furnace according to the present invention.

2. Heating Furnace:

FIG. 12 is a pattern diagram of an embodiment of a heating furnace according to the present invention. As illustrated in the drawing, a heating furnace 800*a* of the present embodiment comprises the abovementioned combustion apparatus 500 and a housing chamber 650. The housing chamber 650 of the heating furnace 800*a* according to the present embodiment comprises a housing space 600 surrounded by furnace walls 630. A combustion gas outlet 70 and a regulated gas outlet 150 of the combustion apparatus 500 are opened to this housing space 600 from the furnace wall 630. This makes it possible to discharge a high-temperature gas adjusted to contain a desired composition from the combustion apparatus 500 into the housing space 600 of the housing chamber 650. As a result, it becomes possible to quickly homogenize the atmosphere in the housing space 600 of the housing chamber 650 into the desired composition while elevating the atmospheric temperature.

Furthermore, according to the heating furnace 800*a* of the present embodiment, by using the abovementioned combustion apparatus 500, it becomes possible to discharge a high-temperature gas with a uniform composition into the housing space 600 of the housing chamber 650. Therefore, it is possible to prevent the compositions of the atmosphere in the housing space 600 of the housing chamber 650 from widely varying according to locations (for example, it is possible to prevent the compositions of the atmosphere from widely differing in the upper and lower parts in the housing space 600 of the housing chamber 650).

In addition, in the heating furnace 800*a* of the present embodiment, a temperature measuring part 670 is provided on the surface of a furnace wall 630 placed on the exact opposite side of the furnace wall 630 to which the combustion gas outlet 70 and regulated gas outlet 150 are opened, in other words, at the location opposite the combustion gas outlet 70 and the regulated gas outlet 150. Thus, it becomes possible to more accurately measure the atmospheric temperature throughout the housing space 600 by providing the temperature measuring part 670 on the surface of the furnace wall 630 placed on the exact opposite side of the furnace wall 630 to which the combustion gas outlet 70 and the regulated gas outlet 150 are opened.

Furthermore, the heating furnace 800*a* of the present embodiment is provided with an inflow regulation means 690. According to this inflow regulation means 690, it becomes possible to change the volume of flames by increasing and decreasing the inflow of the combustible gas from combustible gas inlet 30 and the inflow of air from air inlet 50 based on the atmospheric temperature in the housing space 600 measured by the temperature measuring part 670. Due to such actions of the temperature measuring part 670 and the inflow regulation means 690, in the heating furnace 800*a* of the present embodiment, it becomes possible to more accurately adjust the atmospheric temperature in the housing space 600 of the housing chamber 650 by freely adjusting the amount of heat radiated from the combustion apparatus 500.

Figure 13:
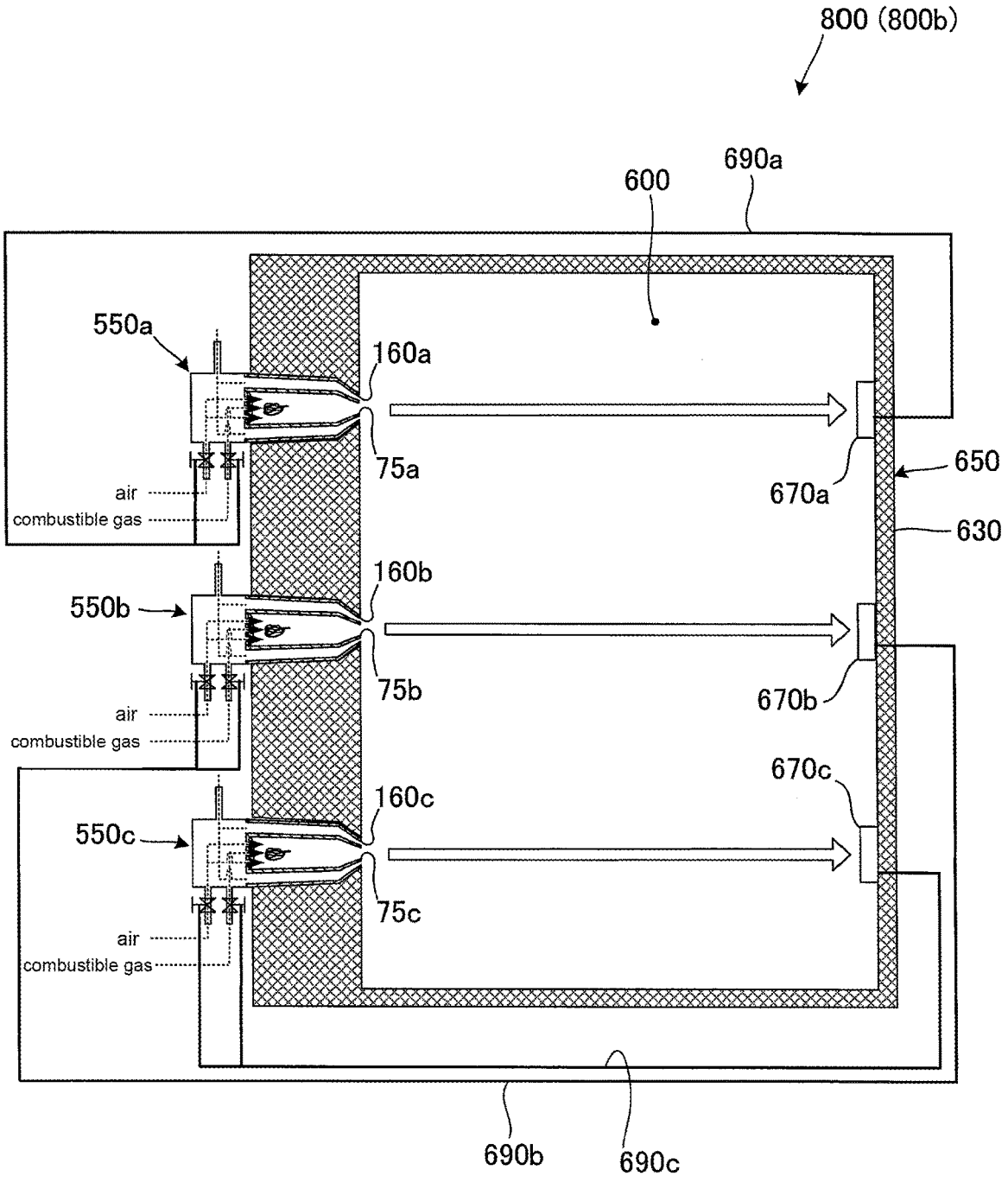
FIG. 13 is a pattern diagram illustrating another embodiment of the heating furnace according to the present invention.

FIG. 13 is a pattern diagram of another embodiment of the heating furnace according to the present invention. A heating furnace 800*b* of the present embodiment is provided with a plurality (specifically, three) of combustion apparatuses 550*a* to 550*c*. Furthermore, the heating furnace 800*b* of the present embodiment is provided with three combustion apparatuses 550*a* to 550*c* on the upper, middle, and lower parts of the housing chamber 650, respectively. As illustrated in the drawing, these three combustion apparatuses 550*a* to 550*c* horizontally discharge a high-temperature gas into the housing space 600.

In addition, the heating furnace 800*b* of the present embodiment is provided with a plurality (specifically, three) of temperature measuring parts 670*a* to 670*c*. Furthermore, each of these temperature measuring parts 670*a* to 670*c* is provided on the upper, middle, and lower parts of the furnace wall 630 on the opposite side of the side on which the combustion apparatuses 550*a* to 550*c* are provided.

Particularly, in the heating furnace 800*b* of the present embodiment, the temperature measuring part 670*a* is provided at the location opposite a combustion gas outlet 75*a* and a regulated gas outlet 160*a* of the combustion apparatus 550*a*; the temperature measuring part 670*b* is provided at the location opposite a combustion gas outlet 75*b* and a regulated gas outlet 160*b* of the combustion apparatus 550*b*; and the temperature measuring part 670*c* is provided at the location opposite a combustion gas outlet 75*c* and a regulated gas outlet 160*c* of the combustion apparatus 550*c*. Accordingly, the temperature measuring part 670*a* can more accurately measure the atmospheric temperature mainly affected by a high-temperature gas discharged from the combustion apparatus 550*a*; the temperature measuring part 670*b* can more accurately measure the atmospheric temperature mainly affected by a high-temperature gas discharged from the combustion apparatus 550*b*; and the temperature measuring part 670*c* can more accurately measure the atmospheric temperature mainly affected by a high-temperature gas discharged from the combustion apparatus 550*c*.

Subsequently, in the heating furnace 800*b* of the present embodiment, each of three inflow regulation means 690*a* to 690*c* can increase and decrease an inflow of the combustible gas as well as an inflow of air from the air inlet in the combustion apparatuses 550*a* to 550*c* based on the atmospheric temperature in the housing space 600 measured by the temperature measuring parts 670*a* to 670*c*.

In the combustion apparatus 800*b* of the present embodiment, the inside of the housing space 600 of the housing chamber 650 is divided into three parts, namely, the upper, middle, and lower parts, making it possible to control the atmospheric temperature in the upper part in the housing space 600 by the combustion apparatus 550*a*, the temperature measuring part 670*a*, and inflow regulation means 690*a*. In addition, the atmospheric temperature in the middle part in the housing space 600 is controlled by the combustion apparatus 550*b*, the temperature measuring part 670*b*, and the inflow regulation means 690*b*. Further, the atmospheric temperature in the lower part in the housing space 600 is controlled by the combustion apparatus 550*c*, the temperature measuring part 670*c*, and the inflow regulation means 690*c*. In other words, in the combustion apparatus 800*b* of the present embodiment, the inside of the housing space 600 of the housing chamber 650 is zoned into three parts, namely, the upper, middle, and lower parts, making it possible to individually control the atmospheric temperature in each of these three parts. As a result, in the combustion apparatus 800*b* of the present embodiment, it becomes possible to more securely homogenize the atmospheric temperature in the housing space 600 of the housing chamber 650.

Figure 14:
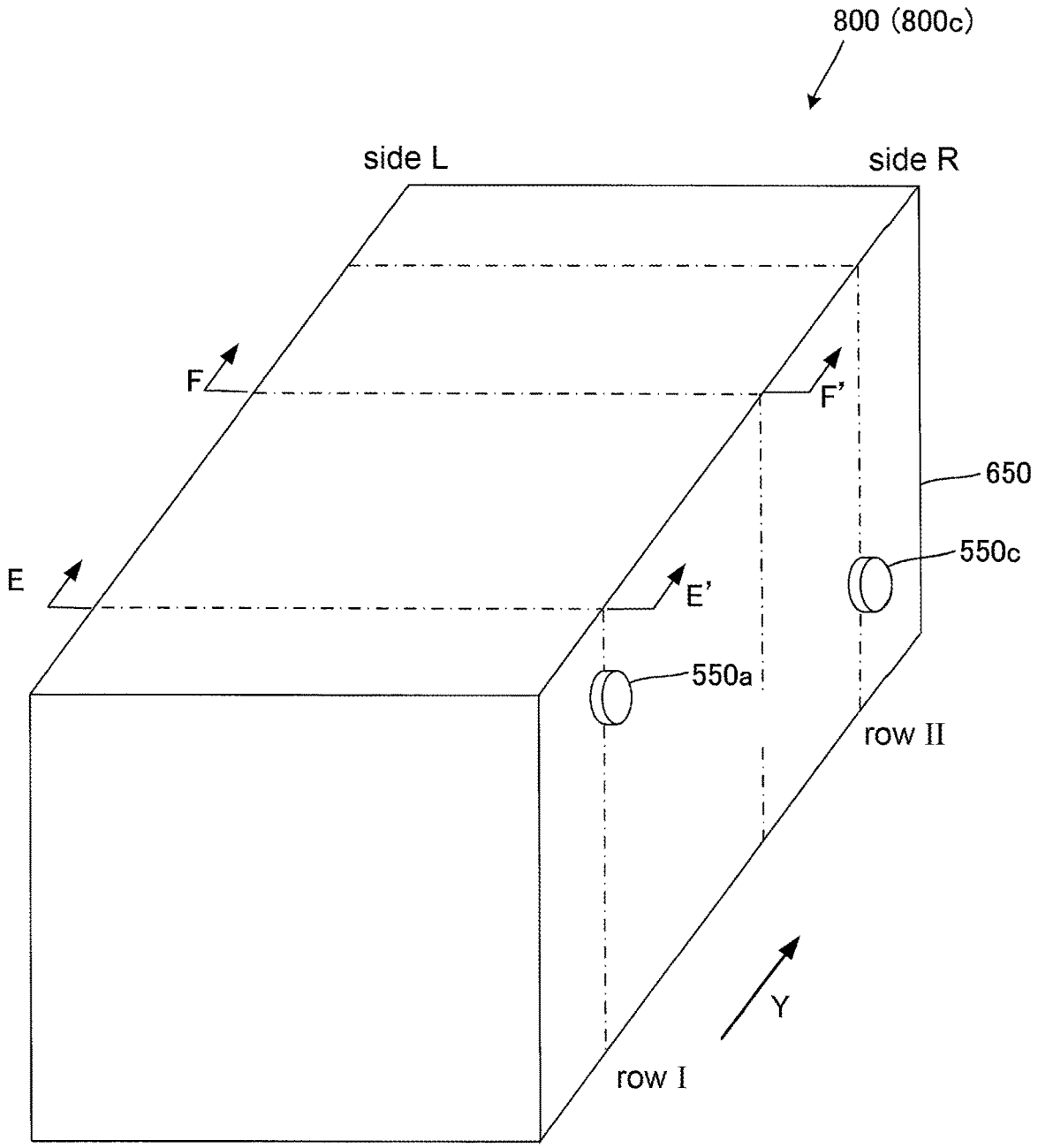
FIG. 14 is a perspective view illustrating the appearance of an embodiment of the heating furnace according to the present invention.

FIG. 14 is a perspective view illustrating the appearance of an embodiment of the heating furnace according to the present invention. As illustrated in the drawing, in a heating furnace 800*c* of the present embodiment, the combustion apparatus 550*a* is provided on the upper part of the housing chamber 650, while the combustion apparatus 550*c* is provided on the lower part thereof. Furthermore, in the heating furnace 800*c* of the present embodiment, the combustion apparatus 550*a* and the combustion apparatus 550*c* are provided in a row I and a row II aligned in the longitudinal direction Y of the housing chamber 650.

Figure 15A:
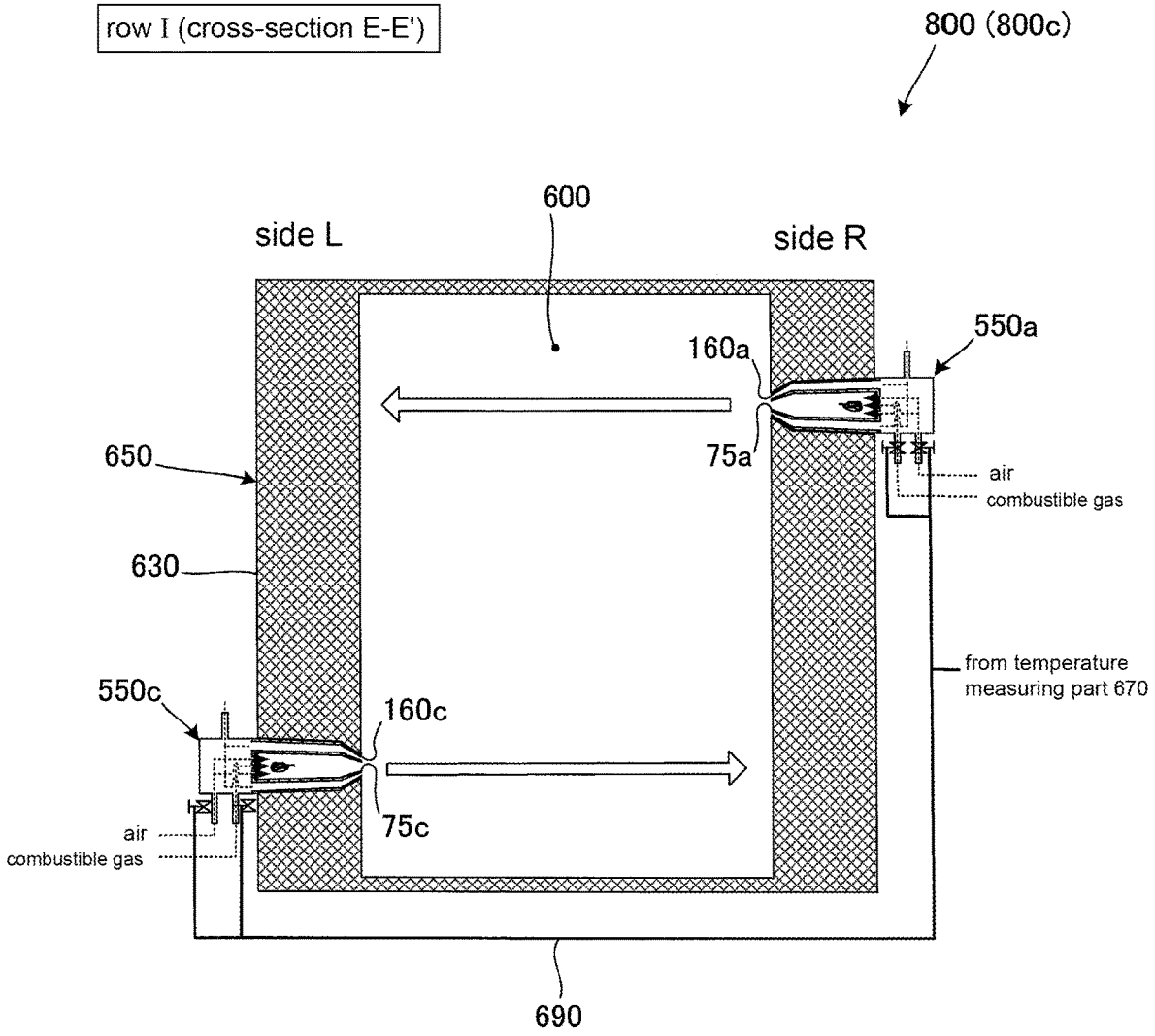
FIG. 15A is a cross-section view along E-E' in FIG. 14.

FIG. 15A is a cross-section view along E-E' in FIG. 14. As illustrated in the drawing, the combustion apparatus 550*a* and the combustion apparatus 550*c* are each provided in the row I in the heating furnace 800*c* of the present embodiment. The combustion apparatus 550*a* is provided on the upper part of the furnace wall 630 on a side R in this row I, while the combustion gas outlet 75*a* and the regulated gas outlet 160*a* of this combustion apparatus 550*a* are opened to the furnace wall 630 on a side L of the opposite side. Furthermore, the combustion apparatus 550*c* is provided on the lower part of the furnace wall 630 on the side L in the row I of heating furnace 800*c* according to the present embodiment, while the combustion gas outlet 75*c* and the regulated gas outlet 160*c* of this combustion apparatus 550*c* are opened toward the furnace wall 630 on the side R of the opposite side.

Furthermore, although not illustrated here, the combustion apparatuses 550*a*, 550*c* are provided in the row II of the housing chamber 650 in the heating furnace 800*c* of the present embodiment while the side L and the side R in row I symmetrically mirror inverted (in the row II, the combustion apparatus 550*a* is provided on the upper part of the side L, while the combustion apparatus 550*c* is provided on the lower part of the side R).

Figure 15B:
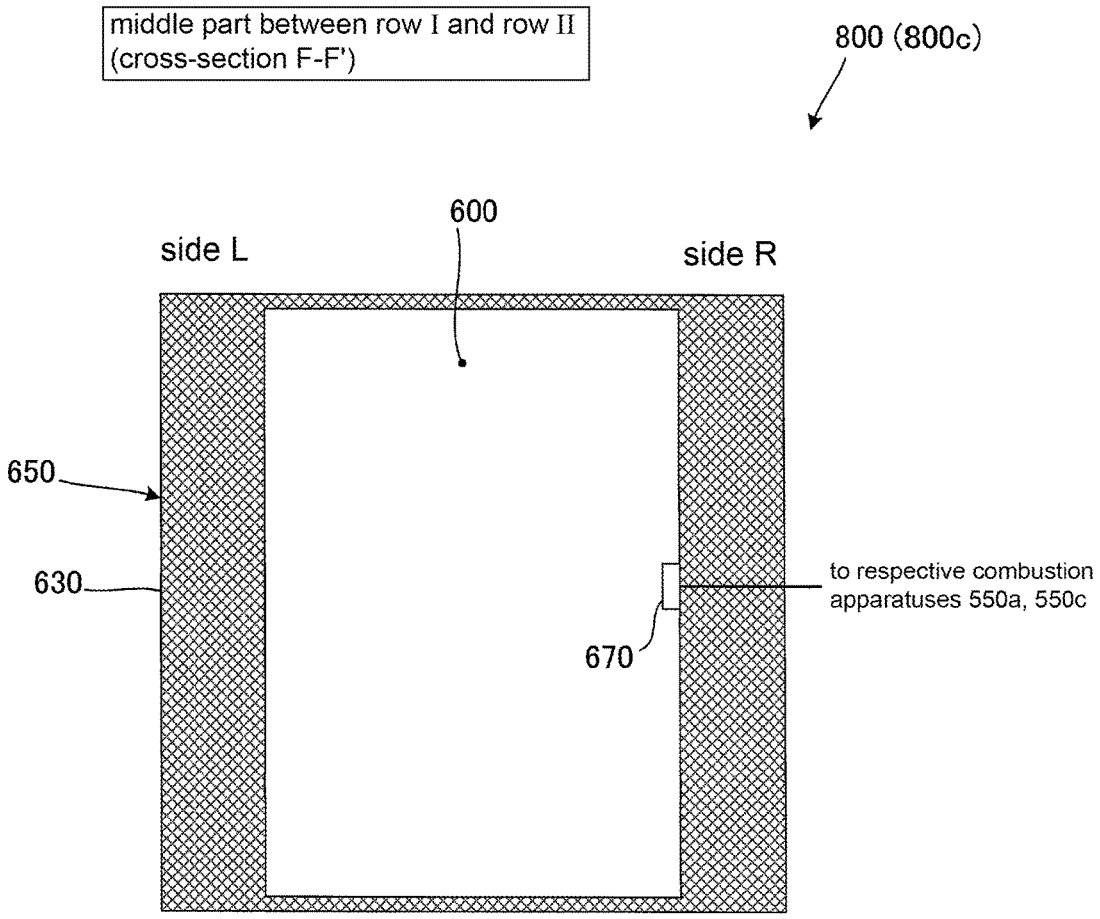
FIG. 15B is a cross-section view along F-F' in FIG. 14.

FIG. 15B is a cross-section view along F-F' in FIG. 14. This F-F' cross-section view corresponds to the middle part between the row I and the row II. As illustrated in the drawing, the combustion apparatuses 550*a*, 550*c* are not placed in this cross-section view along F-F' whereas the temperature measuring part 670 is provided on the center part of the furnace wall 630 on the side R. In other words, the temperature measuring part 670 is provided on the furnace wall 630 opposite to the combustion gas outlets 75*c*, 75*a* along with the regulated as outlets 160*c*, 160*a* of the combustion apparatus 550*c* in the row I and the combustion apparatus 550*a* in the row II. The inflow regulation means 690 increases and decreases the inflow of a combustible gas and the inflow of air from the air inlet in the combustion apparatuses 550*a*, 550*c* in the row I and the combustion apparatuses 550*a*, 550*c* in the row II based on the atmospheric temperature measured by this temperature measuring part 670.

Incidentally, in the heating furnace 800*c* of the present embodiment, the combustion apparatuses 550*a*, 550*c* are provided on the upper and lower parts of the housing chamber 650; however, for example, the combustion apparatus 550 may be provided on each of the upper, middle, and lower parts of the housing chamber 650.

Figure 16:
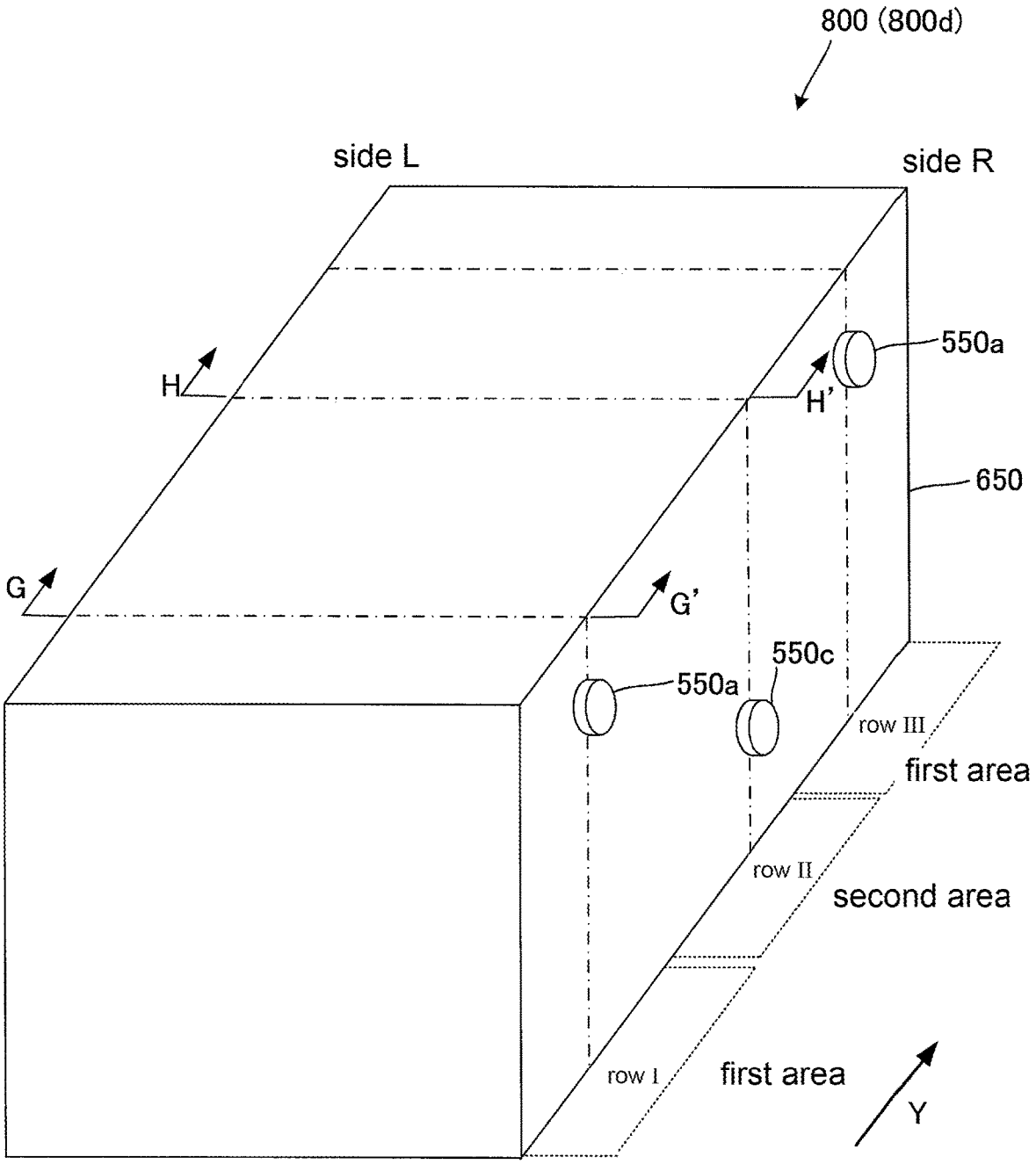
FIG. 16 is a perspective view illustrating the appearance of another embodiment of the heating furnace according to the present invention.

FIG. 16 is a perspective view illustrating the appearance of another embodiment of the heating furnace according to the present invention. As illustrated in the drawing, in a heating furnace 800*d* of the present embodiment, the combustion apparatus 550*a* is provided on the upper part of the housing chamber 650, while the combustion apparatus 550*c* is provided on the lower part thereof. Furthermore, in the heating furnace 800*d* of the present embodiment, the combustion apparatus 550*a* and the combustion apparatus 550*c* are provided in the rows I to III aligned in the longitudinal direction Y of the housing chamber 650.

Figure 17A:
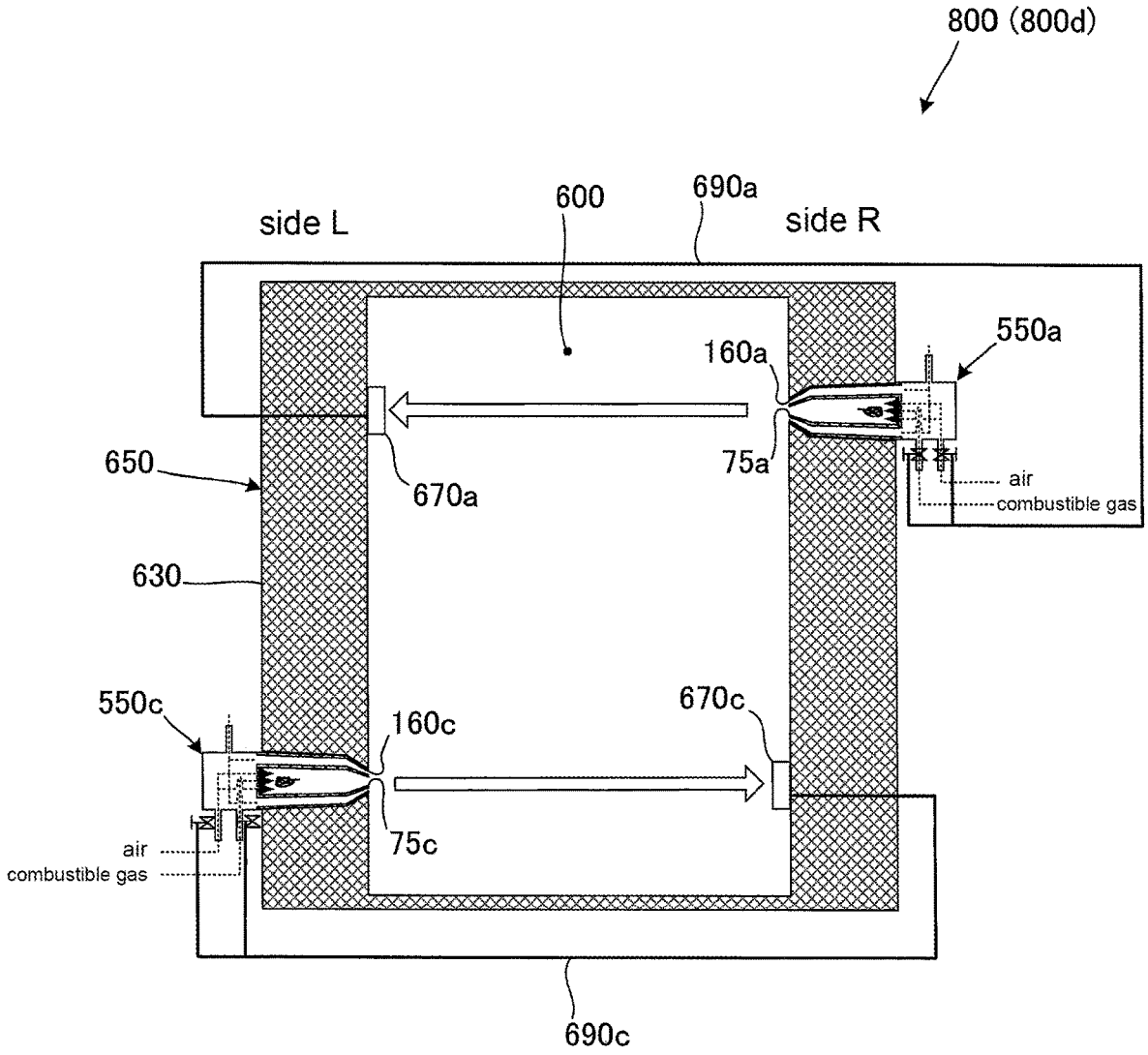
FIG. 17A is a cross-section view along G-G' in FIG. 16.

FIG. 17A is a cross-section view along G-G' in FIG. 16. As illustrated in the drawing, the combustion apparatus 550*a* and the combustion apparatus 550*c* are each provided in the row I in the heating furnace 800*d* of the present embodiment.

The combustion apparatus 550*a* is provided on the upper part of the furnace wall 630 on the side R in the row I of the housing chamber 650 in the heating furnace 800*d* according to the present embodiment, while the combustion gas outlet 75*a* and the regulated gas outlet 160*a* of this combustion apparatus 550*a* are opened toward the furnace wall 630 on the side L of the opposite side. Furthermore, the temperature measuring part 670*a* is provided on the upper part of the furnace wall 630 on the side L opposite to this combustion gas outlet 75*a* and the regulated gas outlet 160*a*. The inflow regulation means 690*a* increases and decreases the inflow of a combustible gas and the inflow of air from the air inlet in the combustion apparatuses 550*a* based on the atmospheric temperature measured by this temperature measuring part 670*a*.

In addition, the combustion apparatus 550*c* is provided on the lower part of the furnace wall 630 on the side L in the row I of the housing chamber 650 in the heating furnace 800*d* of the present embodiment, while the combustion gas outlet 75*c* and the regulated gas outlet 160*c* of this combustion apparatus 550*c* are opened toward the furnace wall 630 on the side R of the opposite side. Furthermore, the temperature measuring part 670*c* is provided on the lower part of the furnace wall 630 on the side R opposite to this combustion gas outlet 75*c* and the regulated gas outlet 160*c*. The inflow regulation means 690*c* increases and decreases the inflow of a combustible gas and the inflow of air from the air inlet in the combustion apparatus 550*c* based on the atmospheric temperature measured by this temperature measuring part 670*c*.

It becomes possible to mix a high-temperature gas flowing from the side R to the side L with a high-temperature gas flowing from the side L to the side R by alternating the direction of flowing a high-temperature gas of a desired composition between the upper and lower parts in the housing space 600 of the housing chamber 650 like the row I of the housing chamber 650 in the heating furnace 800*d* of the present embodiment. As a result, it becomes securely possible to evenly elevate the atmospheric temperature while quickly homogenizing the atmosphere in the housing space 600 of the housing chamber 650 into a desired composition.

Figure 17B:
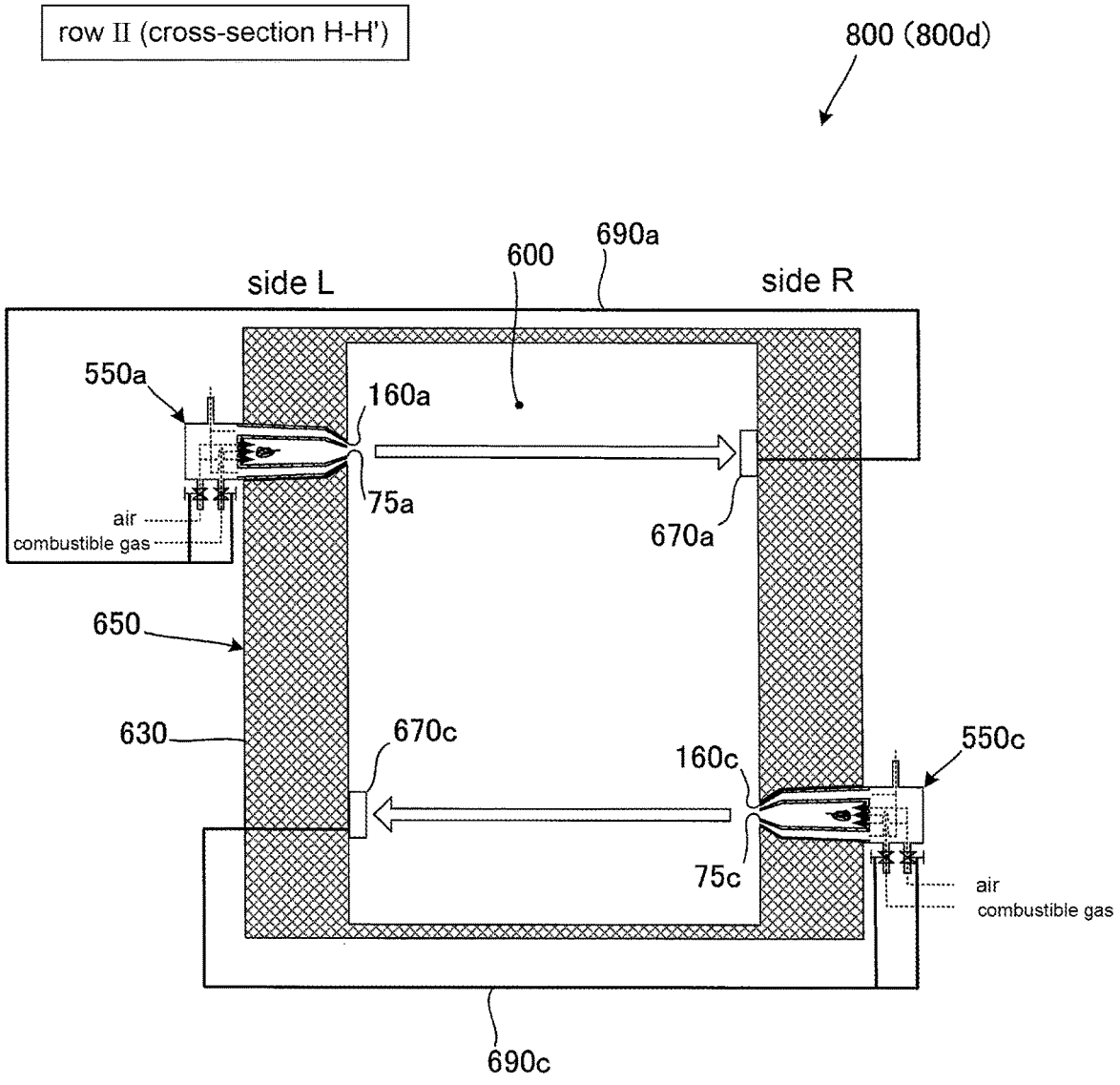
FIG. 17B is a cross-section view along H-H' in FIG. 16.

FIG. 17B is a cross-section view along H-H' in FIG. 16. The combustion apparatuses 550*a*, 550*c* and the temperature measuring parts 670*a*, 670*c* are provided in the row II of the housing chamber 650 in the heating furnace 800*d* of the present embodiment such that the side L and the side R in the row I are symmetrically mirror inverted for understanding FIG. 17B via a comparison with FIG. 17A. Incidentally, although not illustrated here, the combustion apparatuses 550*a*, 550*c* and the temperature measuring parts 670*a*, 670*c* are provided in the row III of the housing chamber 650 in the heating furnace 800*d* of the present embodiment with the same arrangement as that of the row I.

In short, in the housing chamber 650 of the heating furnace 800*d* of the present embodiment, the first area (the row I, row III), in which the combustion apparatus 550*a* is provided on the upper part of the furnace wall 630 on the side R and the combustion apparatus 550*c* is provided on the lower part of the furnace wall 630 on side L, and the second area (the row II), in which the combustion apparatus 550*a* is provided on the upper part of the furnace wall 630 on the side L and the combustion apparatus 550*c* is provided on the lower part of the furnace wall 630 on the side R, are alternately arranged in the longitudinal direction Y of the housing chamber 650. For the case in which the first area and the second area are thus arranged, it becomes securely possible to evenly elevate the atmospheric temperature while quickly homogenizing the atmosphere in the housing space 600 of the housing chamber 650 into a desired composition.

Figure 18:
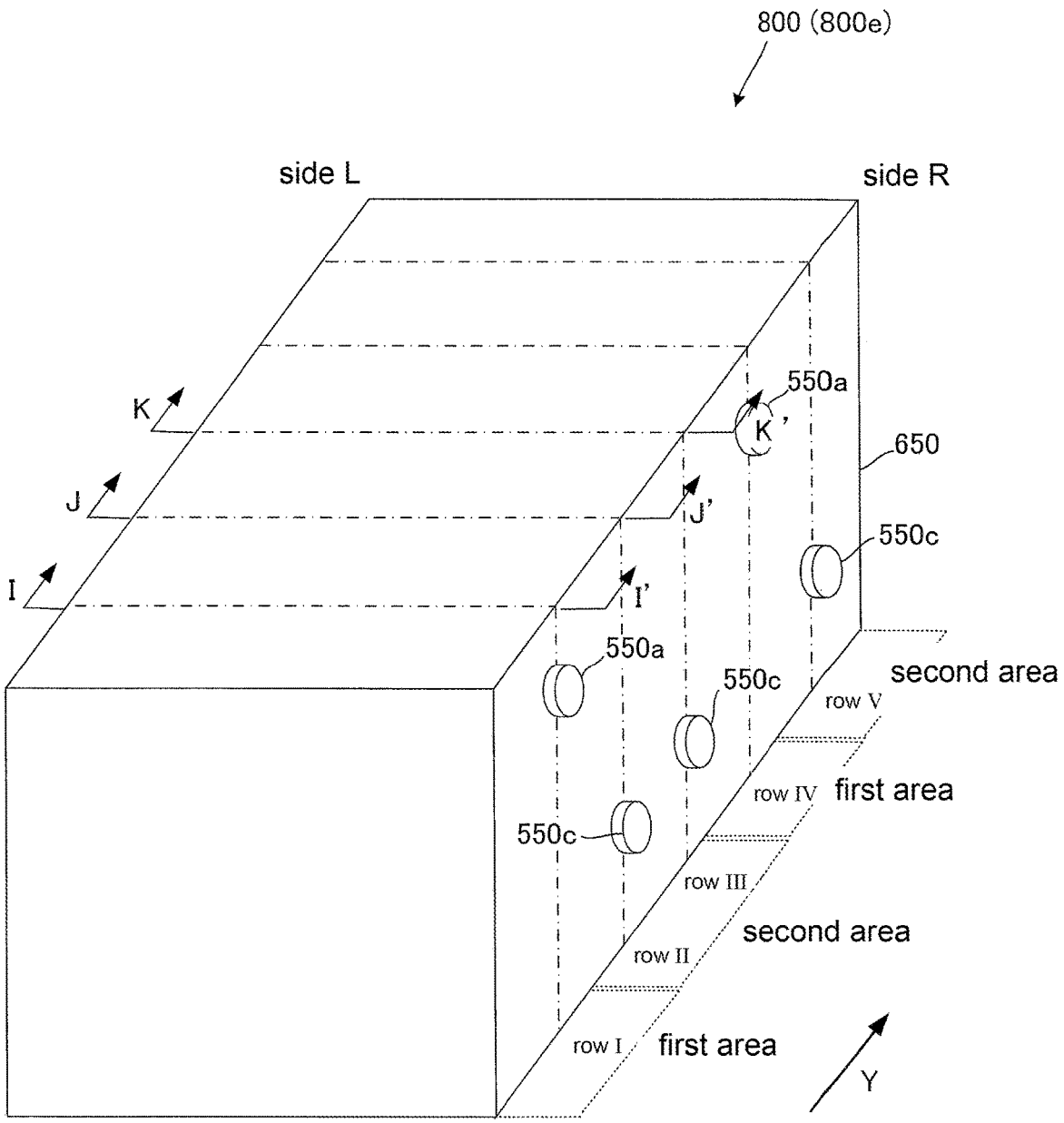
FIG. 18 is a perspective view illustrating the appearance of yet another embodiment of the heating furnace according to the present invention.
Figure 19A:
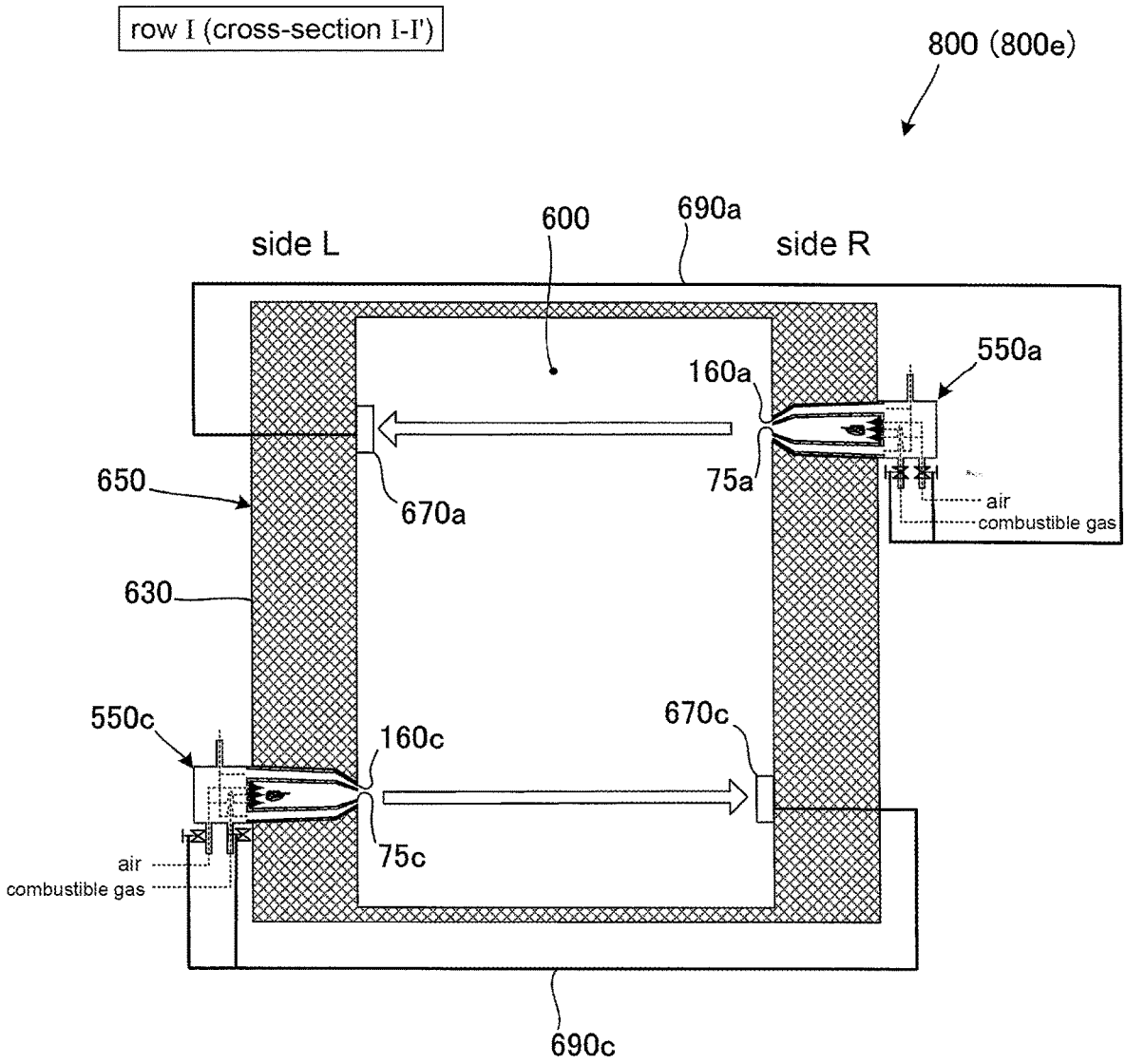
FIG. 19A is a cross-section view along I-I' in FIG. 18.
Figure 19B:
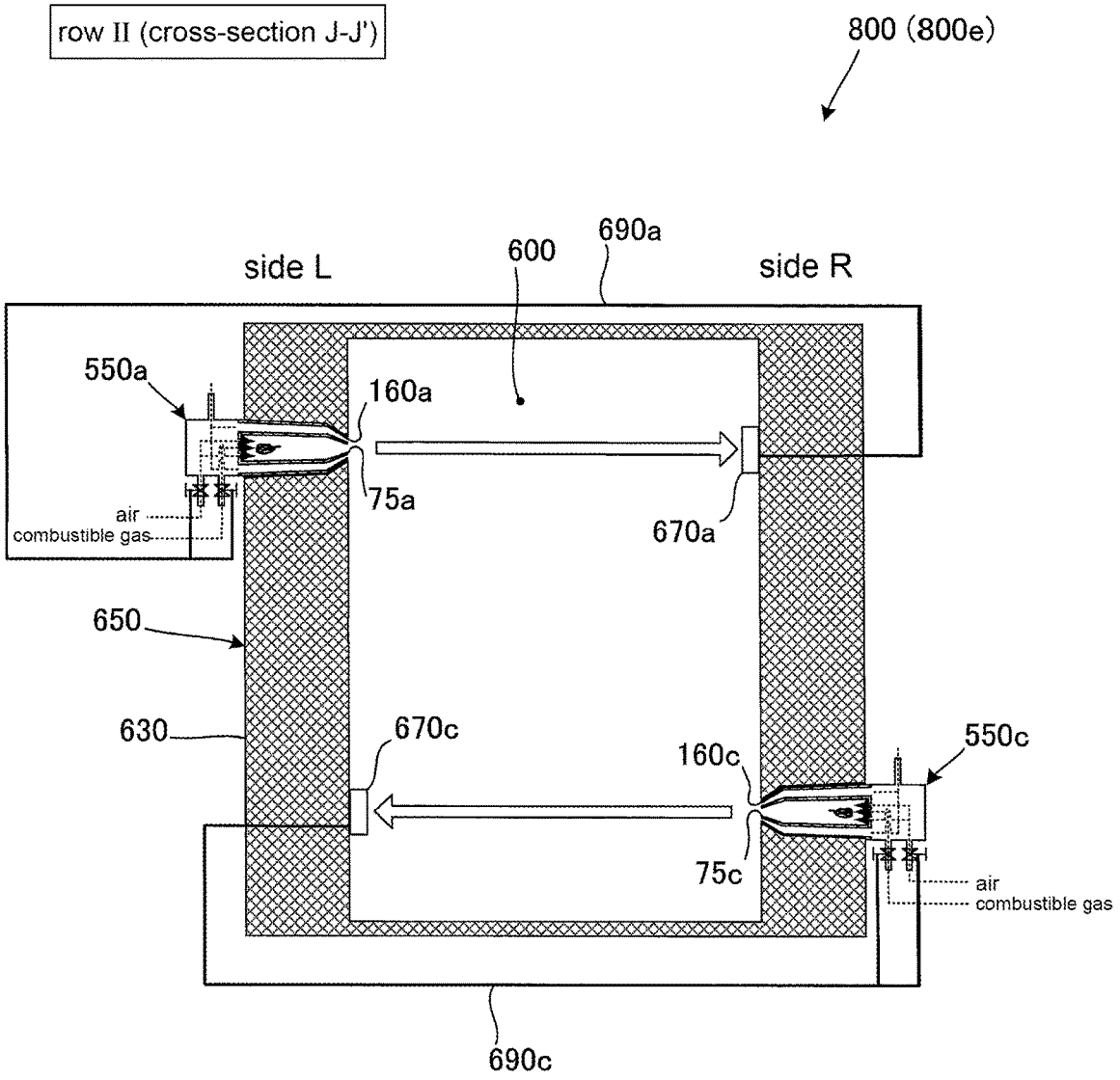
FIG. 19B is a cross-section view along J-J' in FIG. 18.
Figure 19C:
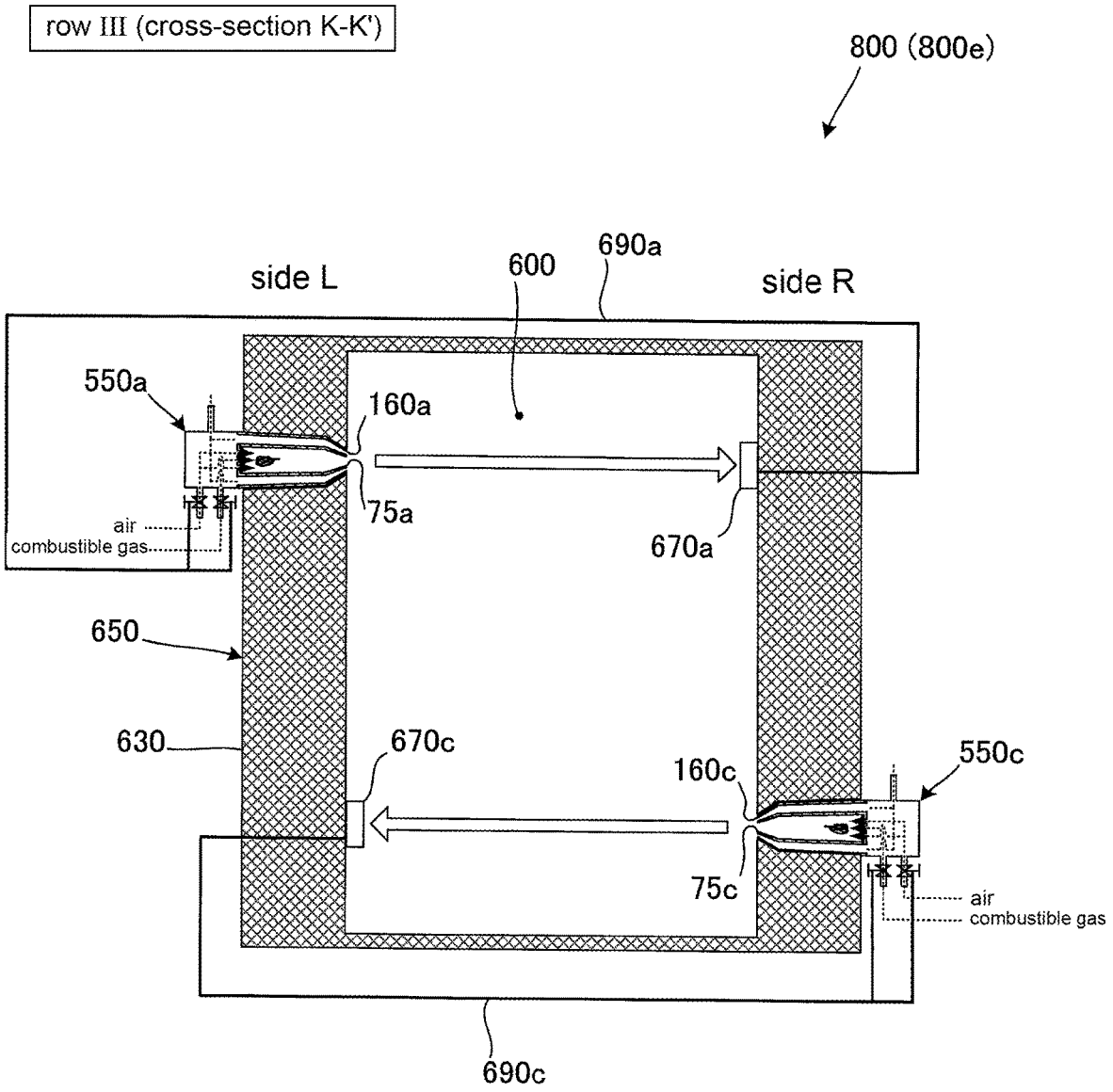
FIG. 19C is a cross-section view along K-K' in FIG. 18.

FIG. 18 is a perspective view illustrating the appearance of yet another embodiment of the heating furnace according to the present invention. Furthermore, each of FIGS. 19A to 19C are cross-section views along I-I', J-J', and K-K' in FIG. 18. A heating furnace 800*e* of the present embodiment corresponds to a further modified example of the abovementioned heating furnace 800*d*. As understood from FIG. 18 and FIGS. 19A to 19C, in the housing chamber 650 of the heating furnace 800*e* of the present embodiment, the first area (the row I, row IV), in which the combustion apparatus 550*a* is provided on the upper part of the furnace wall 630 on the side R and the combustion apparatus 550*c* is provided on the lower part of the furnace wall 630 on the side L, and the second area (the rows II to III, row V), in which the combustion apparatus 550*a* is provided on the upper part of the furnace wall 630 on the side L and the combustion apparatus 550*c* is provided on the lower part of the furnace wall 630 on the side R, are alternately arranged in the longitudinal direction Y of the housing chamber 650.

Incidentally, in the heating furnace 800*e* of the present embodiment, one second area is composed of the row II and the row III. Therefore, in the heating furnace 800*d* of the present embodiment, the second area composed of the row II and the row III comprises two combustion apparatuses 550*a* and two combustion apparatuses 550*c*, respectively (four apparatuses in total), whereas the second area composed of the row V comprises the combustion apparatus 550*a* and the combustion apparatus 550*c* each (two apparatuses in total). In this way, in the same heating furnace 800*e*, the number of the combustion apparatuses 550*a* and the combustion apparatuses 550*c* may differ for each second area. It is defined that, as long as the first and second areas satisfy the arrangement regularity of the combustion apparatus 550*a*, 550*c* and the temperature measuring parts 670*a*, 670*c* [the first area: the combustion apparatus 550*a* on the upper part of the furnace wall 630 on the side R and the combustion apparatus 550*c* on the lower part of the furnace wall 630 on the side L, and the second area: the combustion apparatus 550*a* on the upper part of the furnace wall 630 on the side L, the combustion apparatus 550*c* on the lower part of the furnace wall 630 on the side R], along with the inflow regulation means 690*a*, 690*c* carrying out specific control, the number of combustion apparatuses 550*a*, 550*c*, temperature measuring parts 670*a*, 670*c*, and inflow regulation means 690*a*, 690*c* are not particularly limited.

In addition, the combustion apparatus 550*a* and the combustion apparatus 550*c* along with the temperature measuring part 670*a* and the temperature measuring part 670*c* may not be provided on the same plane at a particular position in the longitudinal direction Y of the housing chamber 650. In other words, the first and the second areas may have appropriate widths in the longitudinal direction Y of the housing chamber 650; moreover, it is defined that the combustion apparatus 550*a* and the combustion apparatus 550*c* along with the temperature measuring part 670*a* and the temperature measuring part 670*c* may be provided within these widths according to the abovementioned arrangement regularity.

Figure 20:
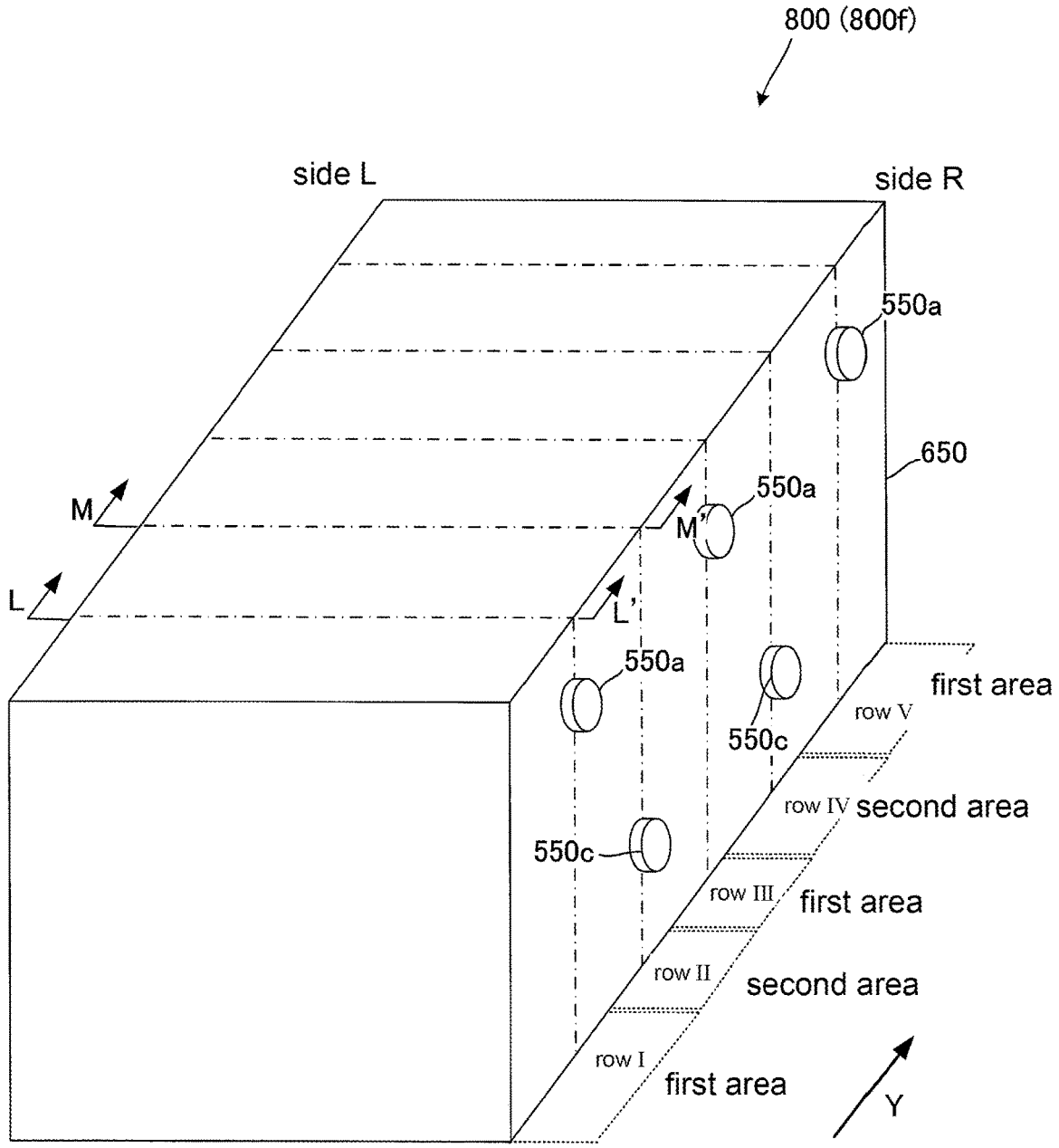
FIG. 20 is a perspective view illustrating the appearance of yet another embodiment of the heating furnace according to the present invention.
Figure 21A:
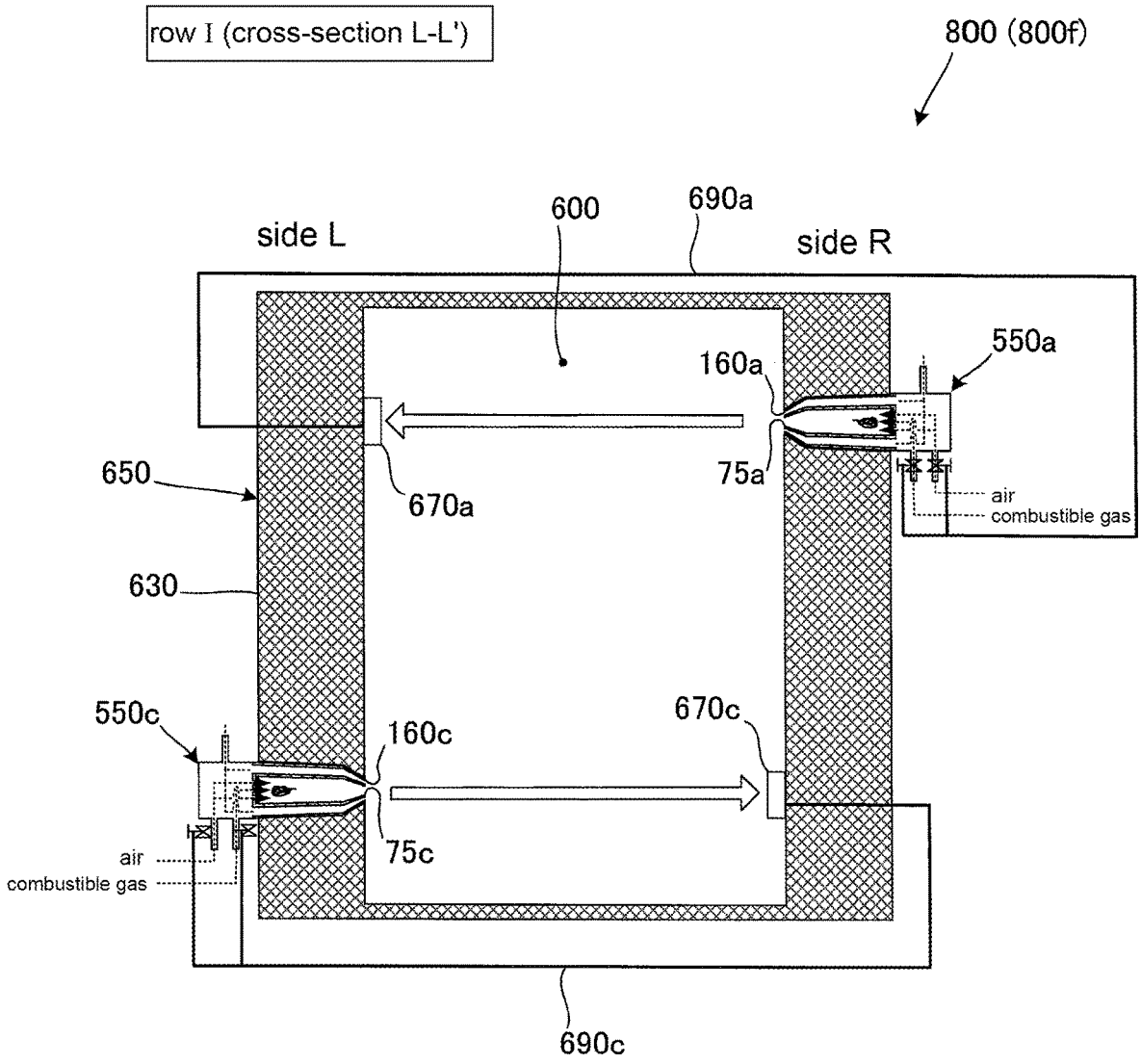
FIG. 21A is a cross-section view along L-L' in FIG. 20.
Figure 21B:
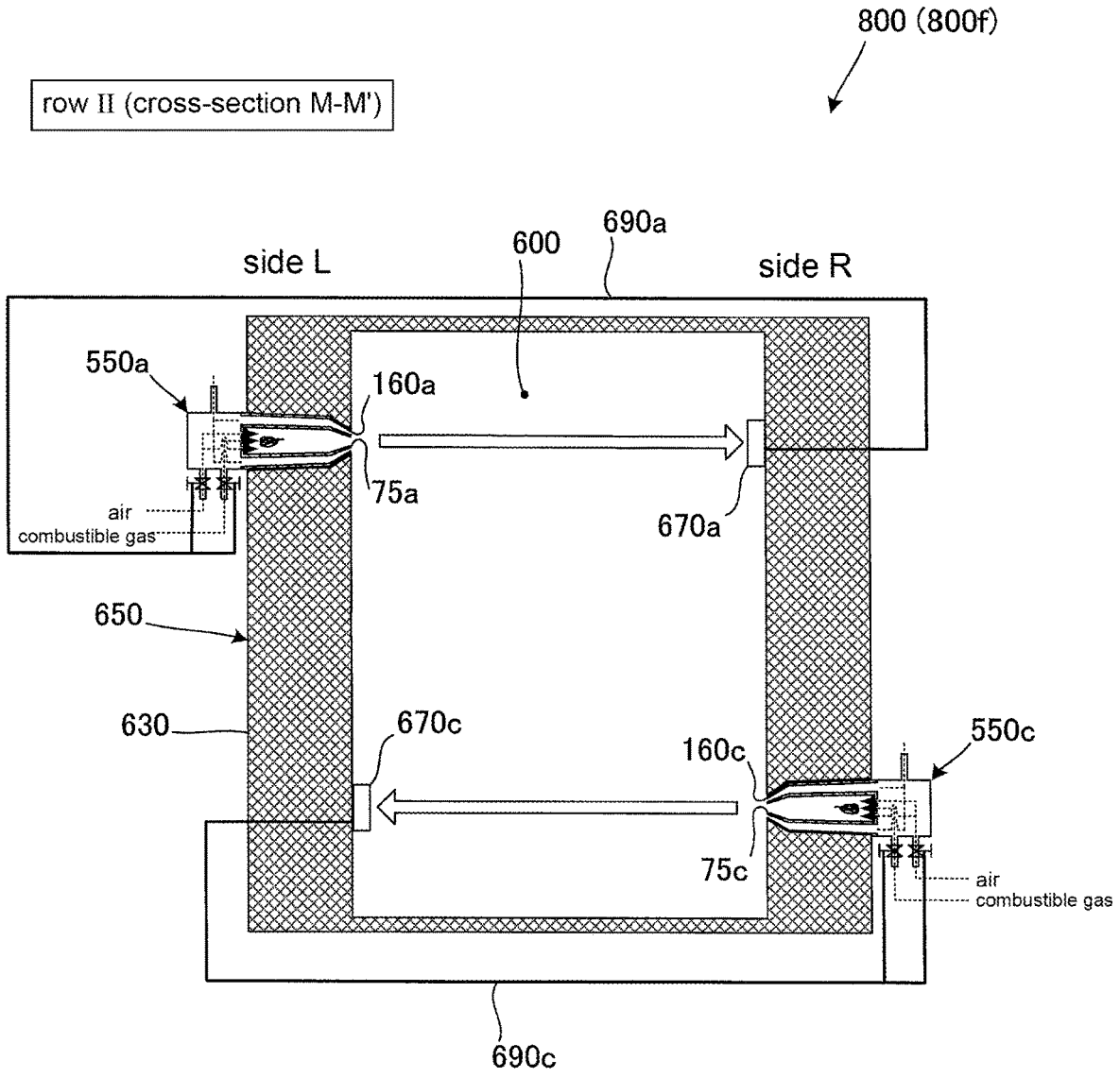
FIG. 21B is a cross-section view along M-M' in FIG. 20.

FIG. 20 is a perspective view illustrating the appearance of yet another embodiment of the heating furnace according to the present invention. Furthermore, FIG. 21A is a cross-section view along L-L' in FIG. 20, while FIG. 21B is a cross-section view along M-M' in FIG. 20. A heating furnace 800*f* of the present embodiment corresponds to yet another modified example of the abovementioned heating furnace 800*d*. As is understood from FIG. 20, FIG. 21A, and FIG. 21B, in the housing chamber 650 in the heating furnace 800*f* according to the present embodiment, the first area (the row I, row III, and row V), in which the combustion apparatus 550*a* is provided on the upper part of the furnace wall 630 on the side R and the combustion apparatus 550*c* is provided on the lower part of the furnace wall 630 on the side L, and the second area (the rows II, IV), in which the combustion apparatus 550*a* is provided on the upper part of the furnace wall 630 on the side L and the combustion apparatus 550*c* is provided on the lower part of the furnace wall 630 on the side R, are alternately arranged in the longitudinal direction Y of the housing chamber 650.

In the heating furnace 800*f* of the present embodiment, all the first and the second areas comprise the combustion apparatus 550*a* and the combustion apparatus 550*c* each (two apparatuses in total), while the vertical arrangement of the combustion apparatus 550 is exchanged in series for each row in the longitudinal direction Y of the housing chamber 650.

The abovementioned heating furnace 800*e* is different from the heating furnace 800*f* in that the number of the combustion apparatuses in the second area (the area located adjacent to the first area composed of the row I) differs. Generally, in the heating furnace 800, the variation in the atmospheric temperature in the housing space 600 tends to differ depending on the size and the arrangement of the object contained in the housing space 600. For example, in the case of using any of the heating furnace 800*e* and the heating furnace 800*f*, taking into consideration the tendency of the variation of the atmospheric temperature in the housing space 600 depending on the object, the heating furnace of either, suitable for homogenization of the atmospheric temperature in the housing space 600, may be applied.

Figure 22:
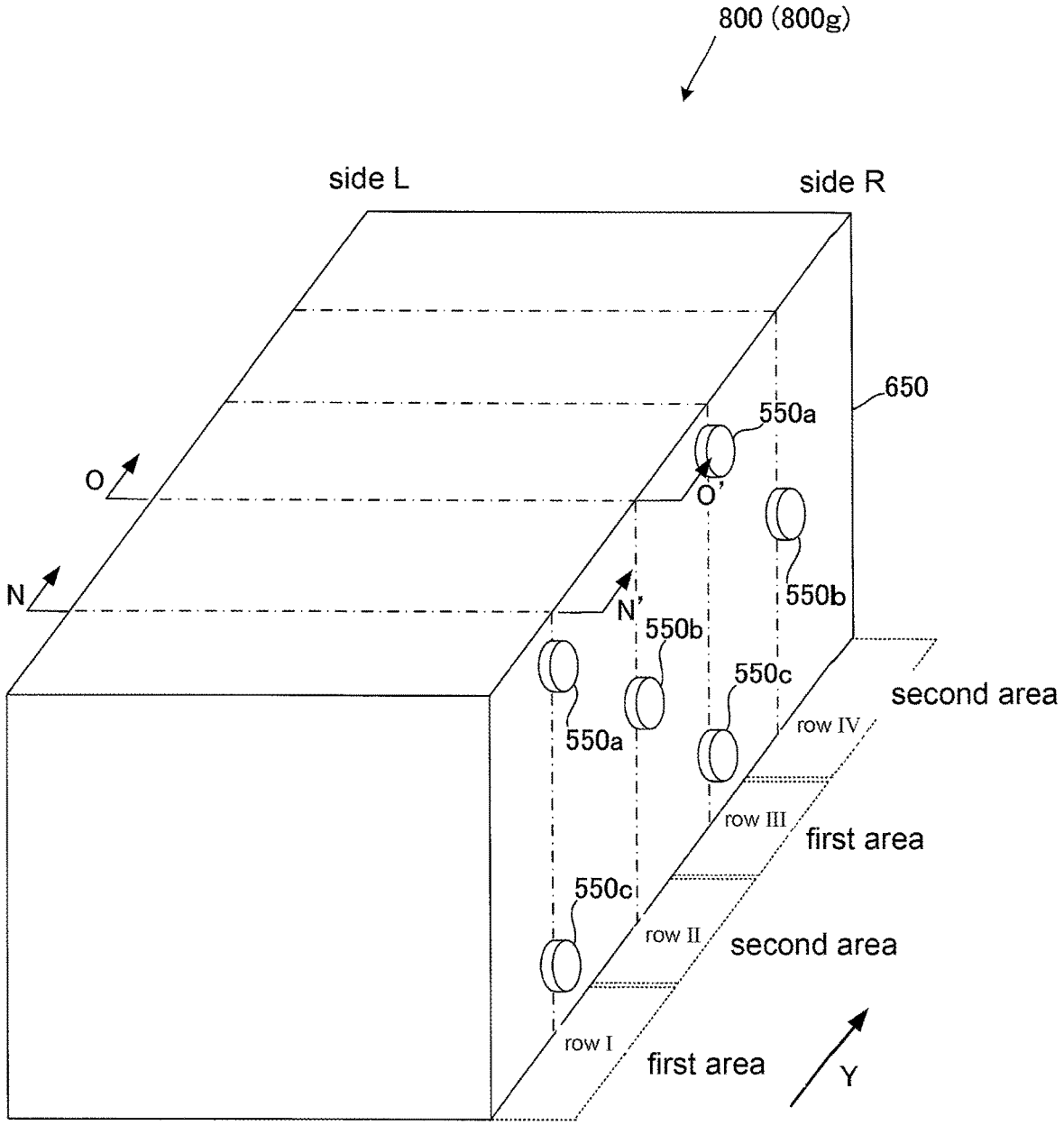
FIG. 22 is a perspective view illustrating the appearance of yet another embodiment of the heating furnace according to the present invention.

FIG. 22 is a perspective view illustrating the appearance of yet another embodiment of the heating furnace according to the present invention. As illustrated in the drawing, in a heating furnace 800*g* of the present embodiment, the combustion apparatus 550*a* is provided on the upper part of the housing chamber 650, the combustion apparatus 550*b* is provided on the middle part thereof, and the combustion apparatus 550*c* is provided on the lower part thereof. Furthermore, in the heating furnace 800*g* of the present embodiment, the combustion apparatuses 550*a* to 550*c* are provided in the rows I to IV arranged in the longitudinal direction Y of the housing chamber 650.

Figure 23A:
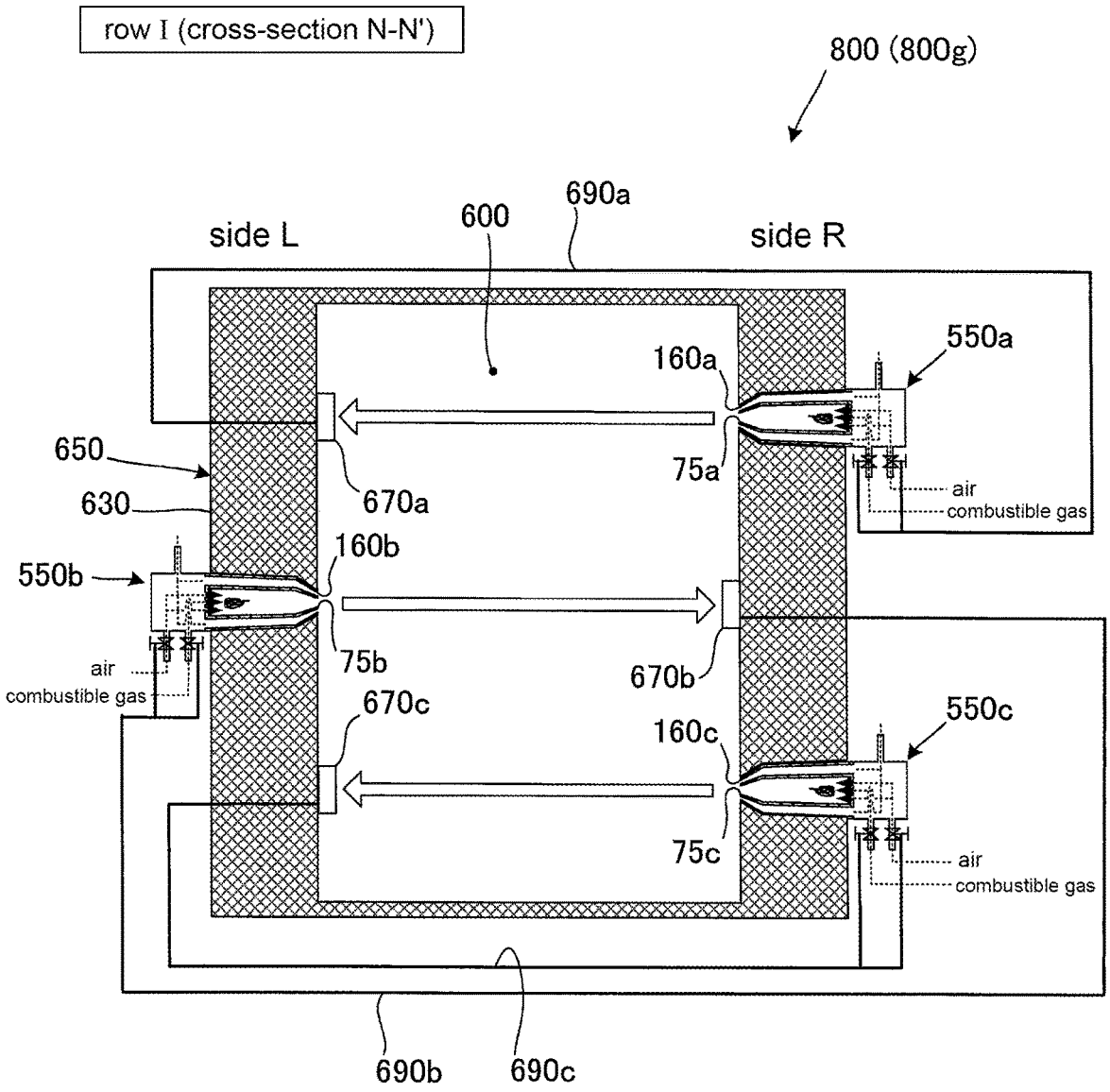
FIG. 23A is a cross-section view along N-N' in FIG. 22.

FIG. 23A is a cross-section view along N-N' in FIG. 22. As illustrated in the drawing, in the heating furnace 800*g* of the present embodiment, the combustion apparatuses 550*a* to 550*c* are each provided in the row I.

In the row I of the housing chamber 650 of the heating furnace 800*g* according to the present embodiment, the combustion apparatus 550*a* is provided on the upper part of the furnace wall 630 on the side R, while the combustion gas outlet 75*a* and the regulated gas outlet 160*a* of this combustion apparatus 550*a* are opened toward the furnace wall 630 on the side L of the opposite side. Furthermore, the temperature measuring part 670*a* is provided on the upper part of the furnace wall 630 on the side L opposite to this combustion gas outlet 75*a* and the regulated gas outlet 160*a*. The inflow regulation means 690*a* increases and decreases the inflow of a combustible gas and the inflow of air from the air inlet in the combustion apparatus 550*a* based on the atmospheric temperature measured by this temperature measuring part 670*a*.

In addition, in the row I of the housing chamber 650 in the heating furnace 800*g* according to the present embodiment, the combustion apparatus 550*b* is provided on the middle part of the furnace wall 630 on the side L, while the combustion gas outlet 75*b* and the regulated gas outlet 160*b* of this combustion apparatus 550*b* are opened toward the furnace wall 630 on the side R of the opposite side. Furthermore, the temperature measuring part 670*b* is provided on the middle part of the furnace wall 630 on the side R opposite to this combustion gas outlet 75*b* and the regulated gas outlet 160*b*. The inflow regulation means 690*b* increases and decreases the inflow of a combustible gas and the inflow of air from the air inlet in the combustion apparatus 550*b* based on the atmospheric temperature measured by this temperature measuring part 670*b*.

Furthermore, in the row I of the housing chamber 650 in the heating furnace 800*g* according to the present embodiment, the combustion apparatus 550*c* is provided on the lower part of the furnace wall 630 on the lower part of the side R, while the combustion gas outlet 75*c* and the regulated gas outlet 160*c* of this combustion apparatus 550*c* are opened toward the furnace wall 630 on the side L of the opposite side. Furthermore, the temperature measuring part 670*c* is provided on the lower part of the furnace wall 630 on the side L opposite to this combustion gas outlet 75*c* and the regulated gas outlet 160*c*. The inflow regulation means 690*c* increases and decreases the inflow of a combustible gas and the inflow of air from the air inlet in the combustion apparatus 550*c* based on the atmospheric temperature measured by this temperature measuring part 670*c*.

It becomes possible to mix a high-temperature gas flowing from the side R to side L with a high-temperature gas flowing from the side L to side R by alternating the flow directions of high-temperature gases with a desired composition among the upper, middle, and lower parts in the housing space 600 of the housing chamber 650 as the row I of the housing chamber 650 in the heating furnace 800*g* of the present embodiment. Furthermore, as the heating furnace 800*g* of the present embodiment is partitioned into three zones, namely, the upper, middle, and lower parts compared to two zones, namely, the upper and lower parts such as abovementioned heating furnaces 800*d*, 800*e*, the mixture of a high-temperature gas in the housing space 600 is enhanced; moreover, it becomes much securely possible to evenly elevate the atmospheric temperature while quickly homogenizing the atmosphere in the housing space 600 of housing chamber 650 into a desired composition.

Figure 23B:
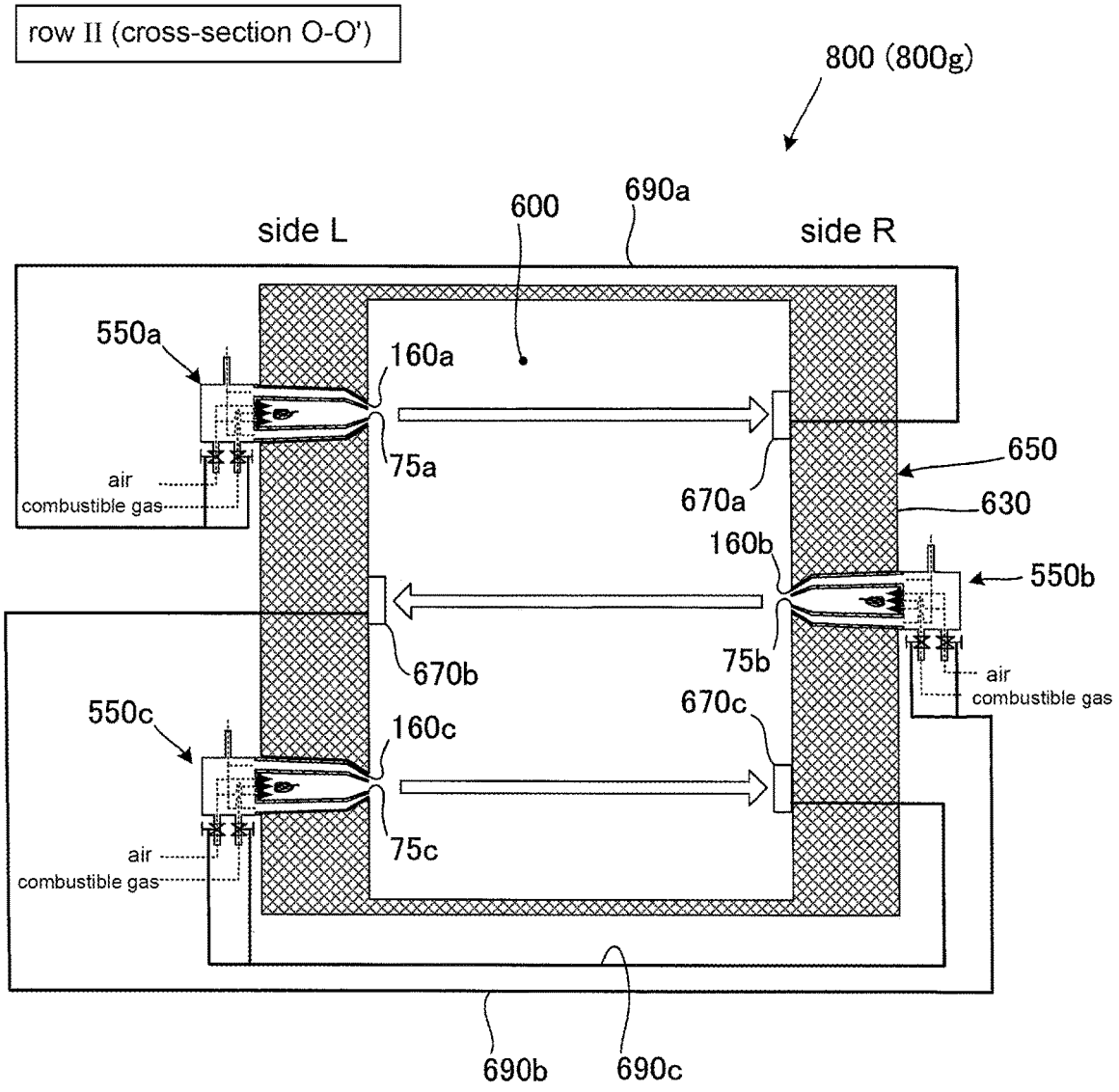
FIG. 23B is a cross-section view along O-O' in FIG. 22.

FIG. 23B is a cross-section view along O-O' in FIG. 22. The combustion apparatuses 550*a* to 550*c* and the temperature measuring parts 670*a* to 670*c* are provided in the row II of the housing chamber 650 in the heating furnace 800*g* of the present embodiment such that the side L and the side R in the row I are symmetrically mirror inverted for understanding FIG. 233 via a comparison with FIG. 23A. Incidentally, although not illustrated here, the combustion apparatuses 550*a* to 550*c* and the temperature measuring parts 670*a* to 670*c* are provided in the row III of the housing chamber 650 in the heating furnace 800*g* of the present embodiment in the same arrangement as that of the row I. In addition, the combustion apparatuses 550*a* to 550*c* and the temperature measuring parts 670*a* to 670*c* are provided in the row IV likewise the row II.

In short, in the housing chamber 650 of the heating furnace 800*g* of the present embodiment, the first area (the row I, row III), in which the combustion apparatus 550*a* is provided on the upper part and the combustion apparatus 550*c* is provided on the lower part of the furnace wall 630 on the side R, while the combustion apparatus 550*b* is provided on the middle part of the furnace wall 630 on the side L, and the second area (row II, row IV), in which the combustion apparatus 550*a* is provided on the upper part and the combustion apparatus 550*c* is provided on the lower part of the furnace wall 630 on the side L, while the combustion apparatus 550*b* is provided on the middle part of the furnace wall 630 on the side R, are alternately arranged in the longitudinal direction Y of the housing chamber 650. For the case in which the first area and the second area are thus arranged, it becomes much securely possible to evenly elevate the atmospheric temperature while quickly homogenizing the atmosphere in the housing space 600 of the housing chamber 650 into a desired composition.

The heating furnaces 800*a* to 800*g* belonging to the abovementioned embodiments of the present invention are preferably used for heat treatment when manufacturing ceramic products and metallic products. This is because ceramic products and metallic products are encouraged to strictly manage the amount of heat to be provided during heat treatment and the atmospheric composition during heating.

INDUSTRIAL APPLICABILITY

The present invention can be used as a combustion apparatus and a heating furnace using the same.

EXPLANATION OF THE SYMBOLS

10: combustion space, 30: combustible gas inlet, 50: air inlet, 70: combustion gas outlet, 75*a* to 75*c*: combustion gas outlet, 100, 100*a*: combustion part, 130: inner wall, 140: end wall, 150, 150*a* to 150*d*: regulated gas outlet, 155: rectification member, 160*a* to 160*c*: regulated gas outlet, 170: outer wall, 200, 200*a* to 200*d*: regulated gas through channel part, 300: air spouting port, 350, 350*a*: partition member, 370: support part, 380: combustible gas through channel, 385: air through channel, 390: bowl part, 393: open end, 395: bottom wall, 397: side wall, 400: first space, 450: second space, 500, 500*a* to 500*e*: combustion apparatus, 550*a* to 550*c*: combustion apparatus, 600: housing space, 630: furnace wall, 650: housing chamber, 670, 670*a* to 670*c*: temperature measuring part, 690, 690*a* to 690*c*: inflow regulation means, 800, 800*a* to 800*g*: heating furnace

The invention claimed is:

1. A heating furnace, comprising:

a combustion apparatus including a combustion part provided with a combustion space for generating a combustion gas by burning a combustible gas and air, a combustible gas inlet opened to said combustion space for allowing said combustible gas to flow into said combustion space, an air inlet opened to said combustion space for allowing said air to flow into said combustion space, and a combustion gas outlet for discharging said combustion gas outside, and a regulated gas through channel part having a regulated gas outlet for discharging an uncombusted regulated gas prepared into a desired composition outside, said regulated gas outlet being adjacent to said combustion gas outlet and opened toward said combustion gas just after being discharged from said combustion gas outlet, wherein an angle between (i) a discharge direction of the uncombusted regulated gas discharged from the regulated gas outlet and (ii) a discharge direction of the combustion gas discharged from the combustion gas outlet is 5 to 90 degrees; and a housing chamber in which a housing space for housing a body to be heated is formed surrounded by a furnace wall with said combustion gas outlet and said regulated gas outlet of said combustion apparatus opened in said housing space.

2. The heating furnace according to claim 1, wherein said regulated gas outlet is annularly opened, and said combustion gas outlet is provided inside the ring of said regulated gas outlet.

3. The heating furnace according to claim 1, comprising a plurality of said regulated gas outlets, wherein said plurality of regulated gas outlets surround said combustion gas outlet.

4. The heating furnace according to claim 2, comprising a structure in which said regulated gas through channel part surrounds said combustion part as seen from a cross-section view crossing said combustion part and said regulated gas through channel part.

5. The heating furnace according to claim 3, comprising a structure in which said regulated gas through channel part surrounds said combustion part as seen from a cross-section view crossing said combustion part and said regulated gas through channel part.

6. The heating furnace according to claim 1, wherein said combustion part comprises:

an air spouting port opened to said combustion space for spouting air in said combustion space in the direction of said combustion gas outlet, and a partition member provided in said combustion space for mixing said combustion gas generated by said combustion with said air spouted from said air spouting port into said combustion space while partitioning said combustible gas flowed from said combustible gas inlet into said combustion space, air flowed from said air inlet into said combustion space, flames generated by the combustion of said air and said combustible gas, and said air spouted from said air spouting port into said combustion space.

7. The heating furnace according to claim 6, wherein, in said combustion part, said partition member is formed in a cylindrical shape with one end closed and the other end opened in the direction of said combustion gas outlet, with said combustible gas inlet and said air inlet further opened inside said cylindrical shape, and said air spouting port is provided such that said air spouted from said air spouting port into said combustion space flows along the outer periphery of said partition member.

8. The heating furnace according to claim 1, comprising:

a temperature measuring part provided at the location opposite to said combustion gas outlet and said regulated gas outlet in said housing space of said housing chamber, which is configured to measure the atmospheric temperature in said housing space; and an inflow regulation means configured to increase or decrease the inflow of said combustible gas from said combustible gas inlet and the inflow of said air from said air inlet based on the atmospheric temperature in said housing space measured by said temperature measuring part.

9. The heating furnace according to claim 8, comprising a plurality of said combustion apparatuses and said temperature measuring part; wherein said temperature measuring part is provided at said furnace wall opposite to said combustion gas outlet and said regulated gas outlet of said combustion apparatus of any one of said plurality of combustion apparatuses, and said inflow regulation means increases or decreases the inflow of said combustible gas of said combustion apparatus and the inflow of said air from said air inlet based on the atmospheric temperature in said housing space measured by said temperature measuring part.

10. The heating furnace according to claim 9, wherein at least one of said combustion apparatuses is provided on the upper and lower parts of said housing chamber, respectively.

11. The heating furnace according to claim 9, wherein at least one of said combustion apparatuses is provided on the upper, middle, and lower parts of said housing chamber, respectively.

12. The heating furnace according to claim 8, comprising:

a plurality of said combustion apparatuses; and a plurality of said temperature measuring parts; wherein at least one of said temperature measuring parts is provided at the location opposite to said respective combustion gas outlet and regulated gas outlet of said plurality of combustion apparatuses, and said inflow regulation means increases or decreases the inflow of said combustible gas of said combustion apparatus opposite to said each temperature measuring part, and the inflow of said air from said air inlet based on the atmospheric temperature in said housing space measured by each of said temperature measuring parts.

13. The heating furnace according to claim 12, wherein at least one of said combustion apparatuses is provided on the upper and lower parts of said housing chamber, respectively.

14. The heating furnace according to claim 13, wherein said housing chamber comprises:

a first area in which said combustion apparatus provided on said upper part of said furnace wall on one side opens said combustion gas outlet and said regulated gas outlet toward said furnace wall on the opposite side of said one side, and said combustion apparatus provided on said lower part of said furnace wall on the opposite side of said one side opens said combustion gas outlet and said regulated gas outlet toward said furnace wall on said one side; and a second area in which said combustion apparatus provided on said upper part of said furnace wall on the opposite side of said one side opens said combustion gas outlet and said regulated gas outlet toward said furnace wall on said one side, and said combustion apparatus provided on said lower part of said furnace wall on said one side opens said combustion gas outlet and said regulated gas outlet toward said furnace wall on the opposite side of said one side; wherein said first area and said second area are alternately arranged in the longitudinal direction of said housing chamber.

15. The heating furnace according to claim 12, wherein at least one of said combustion apparatuses is provided on the upper, middle, and lower parts of said housing chamber, respectively.

16. The heating furnace according to claim 15, wherein said housing chamber comprises:

a first area in which said combustion apparatuses provided on said upper part and said lower part of said furnace wall on one side opens said combustion gas outlet and said regulated gas outlet toward said furnace wall on the opposite side of said one side, and said combustion apparatus provided on said middle part of said furnace wall on the opposite side of said one side opens said combustion gas outlet and said regulated gas outlet toward said furnace wall on said one side; and a second area in which said combustion apparatus provided on said upper part and said lower part of said furnace on the opposite side of said one side wall opens said combustion gas outlet and said regulated gas outlet toward said furnace wall on said one side, and said combustion apparatus provided on said middle part of said furnace wall on said one side opens said combustion gas outlet and said regulated gas outlet toward said furnace wall on the opposite side of said one side; wherein said first area and said second area are alternately arranged in the longitudinal direction of said housing chamber.

* * * * *